US006428433B1

(12) United States Patent
Liechty, II

(10) Patent No.: US 6,428,433 B1
(45) Date of Patent: Aug. 6, 2002

(54) SELECTABLY ALIGNABLE REMOVABLY ATTACHABLE ARROWHEAD TIP

(76) Inventor: Victor Jay Liechty, II, 1250 N. 1750 W., Provo, UT (US) 84604-2955

( * ) Notice: Subject to any disclaimer, the term of this patent is extended or adjusted under 35 U.S.C. 154(b) by 0 days.

(21) Appl. No.: 09/093,294

(22) Filed: Jun. 8, 1998

(51) Int. Cl.[7] ..... F42B 6/08
(52) U.S. Cl. ..... 473/583
(58) Field of Search ..... 473/578, 583, 473/584, FOR 216, FOR 221, FOR 222

(56) References Cited

U.S. PATENT DOCUMENTS

| | | | | |
|---|---|---|---|---|
| 4,166,619 A | | 9/1979 | Bergmann | 473/581 |
| 4,210,330 A | | 7/1980 | Kosbab | 473/584 |
| 4,381,866 A | | 5/1983 | Simo | 473/584 |
| 4,529,208 A | | 7/1985 | Simo | 473/584 |
| 4,558,868 A | | 12/1985 | Musacchia | 473/584 |
| 4,565,377 A | | 1/1986 | Troncoso | 473/584 |
| 4,616,835 A | | 10/1986 | Trotter | 473/583 |
| 4,643,435 A | | 2/1987 | Musacchia | 473/584 |
| 4,742,637 A | | 5/1988 | Musacchia | 43/6 |
| 5,044,640 A | | 9/1991 | Del Monte et al. | 473/584 |
| 5,078,407 A | | 1/1992 | Carlston et al. | 473/583 |
| 5,090,709 A | | 2/1992 | Johnson | 473/584 |
| 5,160,148 A | | 11/1992 | Musacchia, Sr. | 473/584 |
| 5,178,399 A | | 1/1993 | Garoutte | 473/584 |
| 5,286,035 A | | 2/1994 | Ward | 473/584 |
| 5,482,293 A | | 1/1996 | Lekavich | 473/584 |
| 5,482,294 A | | 1/1996 | Sullivan et al. | 473/584 |
| 5,494,298 A | * | 2/1996 | Maleski | 473/584 |
| 5,496,043 A | | 3/1996 | Ester | 473/584 |
| 5,564,713 A | | 10/1996 | Mizek et al. | 473/583 |
| 5,636,846 A | * | 6/1997 | Tinsley | 473/584 |
| 5,820,498 A | | 10/1998 | Maleski | 473/584 |
| 5,857,930 A | | 1/1999 | Troncoso | 473/583 |
| 5,879,252 A | | 3/1999 | Johnson | 473/583 |
| 6,045,468 A | * | 4/2000 | Tinsley et al. | 473/584 |

* cited by examiner

*Primary Examiner*—John A. Ricci

(57) ABSTRACT

Removably attachable arrowhead tips that are selectively alignable in specific orientation with structures of their corresponding arrowhead bodies. Such arrowhead tips allow consistent and repetitive alignment of cutting edges of arrowhead tip facet junctures with the cutting edges of tip blades and/or the cutting edges of their corresponding arrowhead blades at all times, such as when replacing a damaged tip.

44 Claims, 11 Drawing Sheets

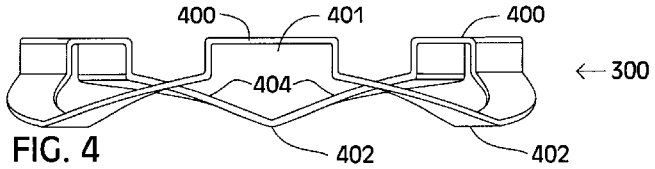
FIG. 4
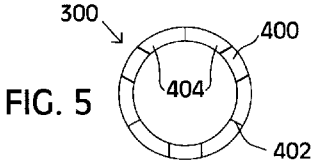
FIG. 5
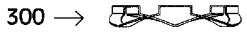
FIG. 6
FIG. 2
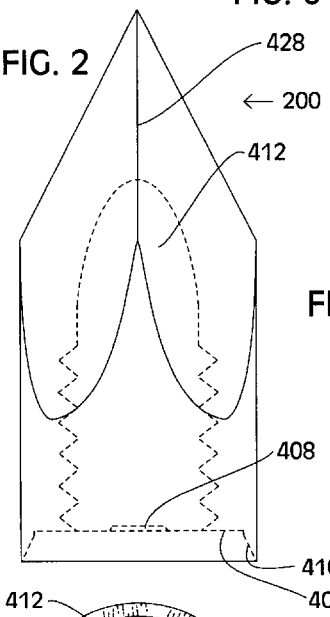
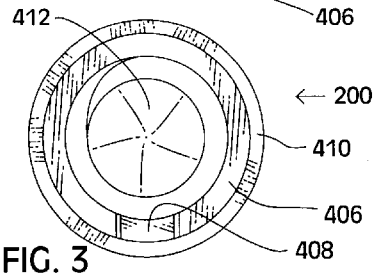
FIG. 3
FIG. 1
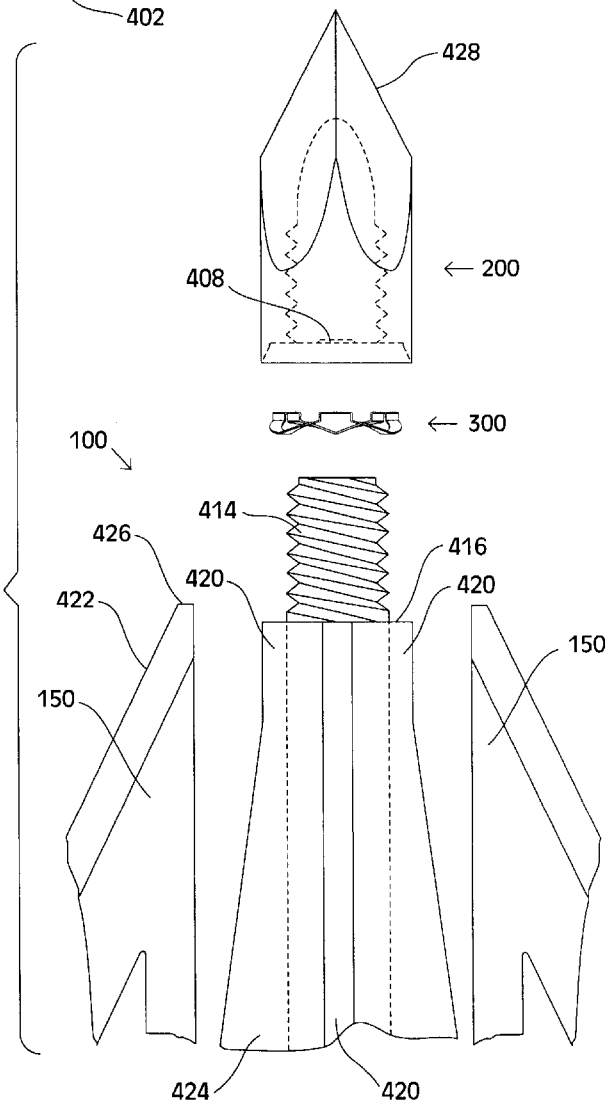

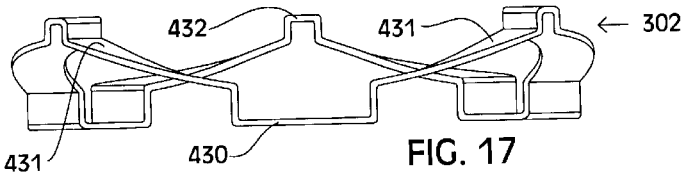
FIG. 17
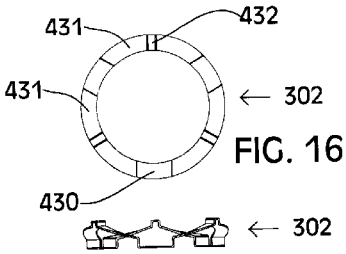
FIG. 16
FIG. 15
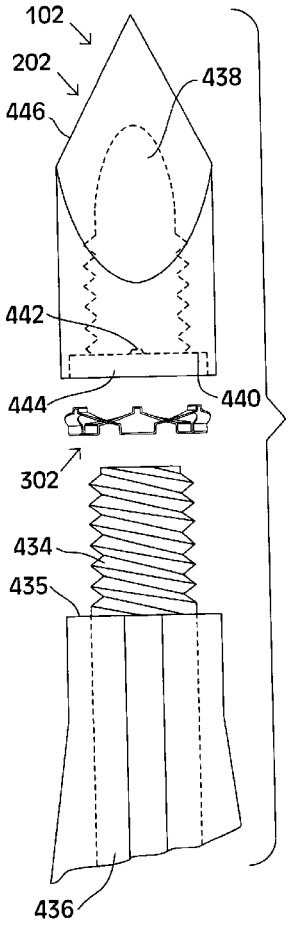
FIG. 14
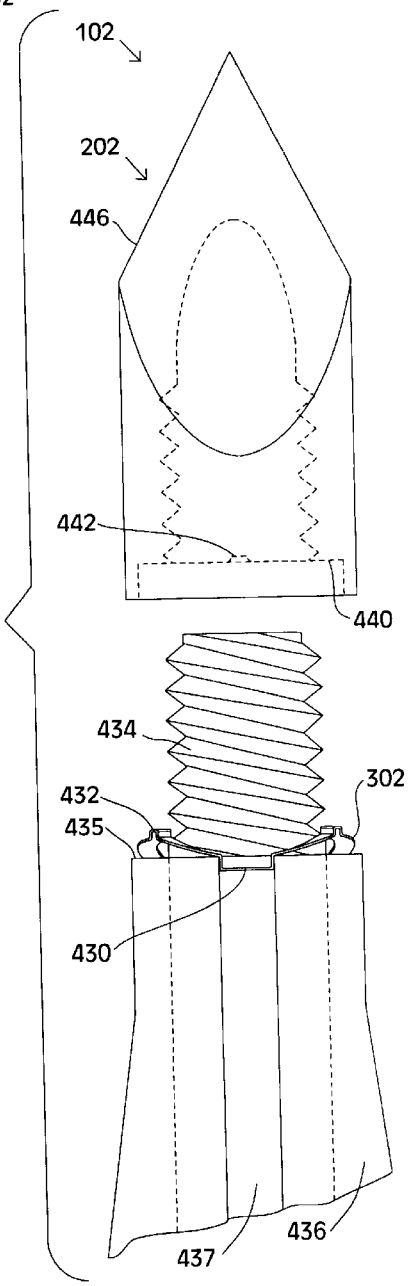
FIG. 18
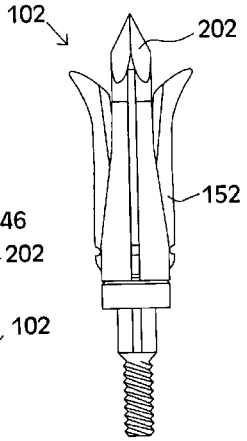
FIG. 19
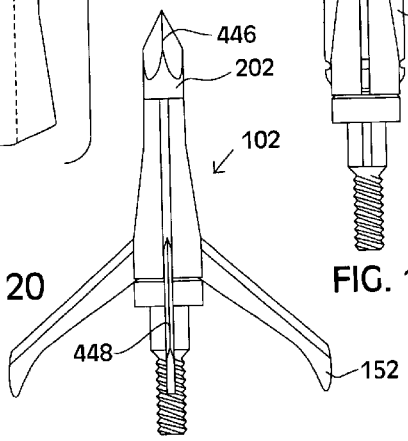
FIG. 20

460
458
460
461
304
459
459

458
304
450
450

456
453
454
452
450
304
450
458
456
461

304
462
462
461
456
460
462
460

468
466
464
465

50
50
462
204
447
104
250
474
474
472
280
476
478
304

453
452
456
457
454
450
104
280
204
470
468
447

454
153

506
504
308
502
503
208
254
512
516
514
284
513
520
518
308
511
510
524
508
523
108
522

516
514
512
511
513
284
284
520
510
308
524
502
508
503
108
523

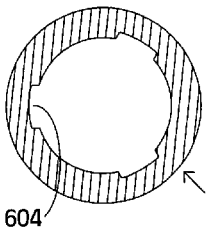
FIG. 49
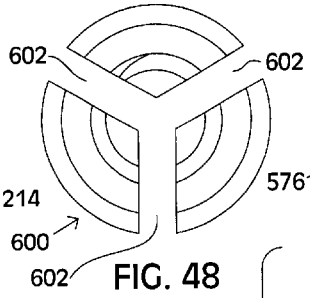
FIG. 48
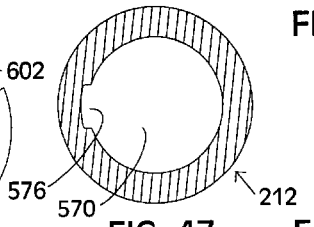
FIG. 47
FIG. 44
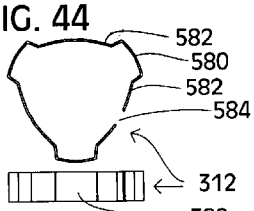
FIG. 43
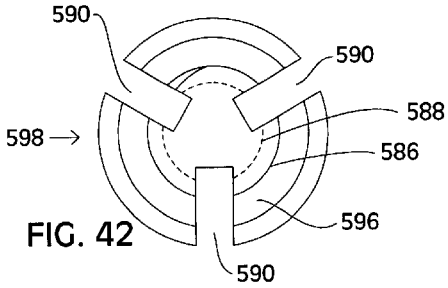
FIG. 42
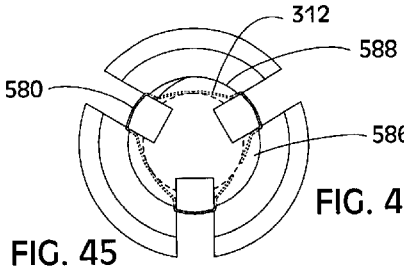
FIG. 45
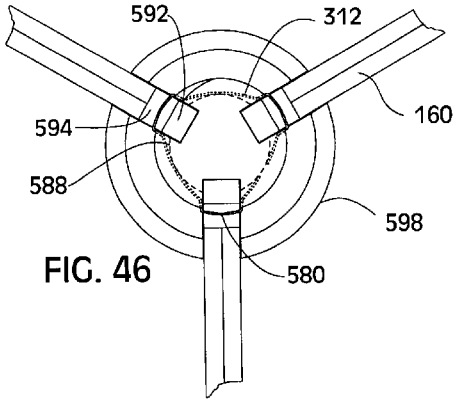
FIG. 46
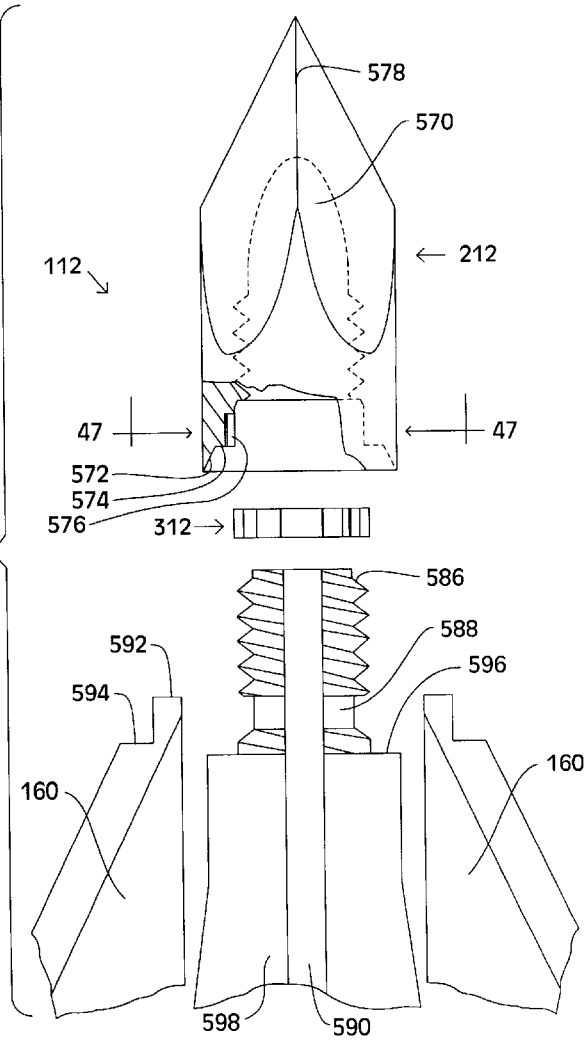
FIG. 41

SELECTABLY ALIGNABLE REMOVABLY ATTACHABLE ARROWHEAD TIP

BACKGROUND

1. Field of the Invention

This invention relates generally to the forward leading end point of arrowheads or arrowhead tips, and more particularly to removably attachable arrowhead tips that may be selectively aligned in specific orientation with structures of their corresponding arrowhead bodies, such as specifically aligning cutting edges of arrowhead tip facet junctures with the cutting blades of the arrowhead.

2. Description of Prior Art

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight, as it rotates. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

The most common type of arrowhead used in hunting is the fixed-blade arrowhead, which has a pointed tip end used for penetrating, and fixed blades or non-pivotal blades that each have a razor sharp edge for cutting. Conventional fixed-blade arrowheads blades are held in a fixed position on the arrowhead, and most such blades are replaceable. The replaceable blades attach to the arrowhead body in longitudinal grooves called blade slots. The tip of the arrowhead may be separably attachable to the arrowhead body or may be integral with it. Arrowheads for hunting are generally known as broadheads.

Another popular type of arrowhead for hunting is the blade-opening arrowhead. Blade-opening arrowheads, like conventional fixed-blade arrowheads generally have an elongated arrowhead body, a tip end, and a threaded opposite end. The blades of blade-opening arrowheads have an attachment end which attaches the blades to the arrowhead body by a pivot pin, so that the blades can pivot or rotate in a plane between a first selectable position—the retracted position, and a second selectable position—the open position. Blade-opening arrowheads also come in a variety of different types and styles. The blades of the most common type of blade-opening arrowheads, when in the retracted position have a leading blade end positioned near the tip of the arrowhead that protrudes outward from the arrowhead body. The leading blade ends of such blade-opening arrowheads, rotate away from the arrowhead body in a rearward direction when penetrating an animal. Particularly, the leading blade ends catch on the animal's surface and serve to lever or rotate the blades into the open position, thus exposing the sharp cutting edges of the blades and cutting the animal. The blades of blade-opening arrowheads are also received in blade slots, which are machined or formed into the side of the arrowhead body.

Broadheads kill game animals by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The cutting diameter of an arrowhead is determined by how far each cutting blade extends outward from the arrowhead body. The further the blades extend outward the larger the cutting diameter is, and therefore the more cutting potential the arrowhead has.

The forward end or tip of most broadheads have a chisel type tip such as the three sided hollow ground trocar tip. The chisel tips generally have multiple sides or facets with a cutting edge formed at the juncture of each two facets. Typically there is the same number of cutting edges on the arrowhead tip at facet junctures as there is arrowhead cutting blades. To further aid in increased penetration it is desirable to align the cutting edges of the arrowhead tip with the cutting edges of the arrowhead blades. This increases penetration since the cutting blades follow the exact cut path created by the tip, and thus less kinetic energy is depleted.

Some broadhead manufacturers currently align the arrowhead tip cutting edges with the cutting edges of the arrowhead blades by attaching the tips to the arrowhead bodies via press fitting—where each tip is non-removably pressed onto a corresponding arrowhead body. Since press fitting is generally done with robotics it is possible to consistently align the cutting edges of the arrowhead tip with the blade slots of the arrowhead body, therefore when the cutting blades are attached in the blade slots the cutting edges of the blades are aligned with the cutting edges of the tip. One problem inherent with arrowheads having press fit arrowhead tips is that the tips are not replaceable. So should a press fit tip's cutting edge become damaged, for example as commonly happens when the arrow misses its mark and impacts a rock or another hard object, the entire arrowhead must be disregarded or be shot with a dull tip.

Other broadhead manufacturers use removably attachable arrowhead tips so that the arrowhead can always have an optimally structured and sharp tip, by being replaced when damaged. The removably attachable arrowhead tips generally screw-on to their respective arrowhead bodies. A problem with screw-on arrowhead tips is that they do not produce a consistent orientation of tip cutting edges with the arrowhead blades. This makes it so the tip cutting edges rarely align with the arrowhead blade cutting edges despite how exact the tolerances of the manufacturing protocol are.

It is apparent that there is a need for a replaceable or removably attachable arrowhead tip that is capable of being consistently aligned with a corresponding arrowhead body such that the cutting edges of the arrowhead tip are in-line with the cutting edges of the arrowhead blades every time the tip or a tip is attached thereto.

SUMMARY OF THE INVENTION

It is an object of the present invention to provide a replaceable or removably attachable arrowhead tip that is capable of being consistently aligned with a corresponding arrowhead body such that the cutting edges of the arrowhead tip are in-line or coplanar with the cutting edges of the arrowhead blades every time the tip or a tip is attached thereto.

It is another object of the present invention to provide a replaceable or removably attachable arrowhead tip having removably attachable tip blades, which tip is capable of being consistently aligned with a corresponding arrowhead body such that the cutting edges of the arrowhead tip and the cutting edges of the tip blades are in-line or coplanar with the cutting edges of the arrowhead blades every time the tip is attached thereto.

The foregoing objects and advantages and other objects and advantages of the present invention are accomplished as according to one embodiment of this invention with a three faceted hollow ground trocar arrowhead tip that attaches to the forward end of a fixed-blade arrowhead body. The trocar tip has a female cavity that screws onto a male stud of the arrowhead body. The trocar tip also, has an internal annular wall that has a notch formed thereon, such that the notch is in-line or coplanar with one of the three tip facet juncture cutting edges. The arrowhead body has three blade slots shaped such that when an arrowhead blade is inserted in each slot the forward leading end of each blade extends forwardly of an annular shelf or necked down region of the arrowhead body. A substantially flat metal alignment washer is then situated upon the three extending forward arrowhead blades and upon the annular shelf of the arrowhead body so as to encircle around the threaded stud before the trocar tip is attached thereto. The alignment washer serves to align and lock the arrowhead tip such that its facet juncture cutting edges are oriented coplanar with the cutting edges of the arrowhead cutting blades. The alignment washer has three protrusions each wide enough to fit over the forward end of a corresponding arrowhead blade, and a cantilever or deflectable section between each of the protrusions. Each of the three cantilever sections has a fulcrum which is defined at the rearward most section thereof.

Therefore, when an alignment washer is situated on such an arrowhead body having three such arrowhead blades attached thereto, each protrusion fits over the forward end of one of the arrowhead blades such that the each forward blade end mates within a void created by the corresponding protrusion, and all three of the fulcrums abut against the annular shelf of the arrowhead body. The mating of the blades and protrusions prevents the alignment washer from rotating circumferentially about the arrowhead body or from being displaced or moved relative to the arrowhead body in any undesirably fashion, while yet allowing enough space between the forward most end of each arrowhead blade and corresponding protrusions for each protrusion to have axial movement or displacement in a rearward direction a certain distance before coming into abutment with the forward end of the arrowhead blade. Therefore, when the trocar tip is screwed onto the stud of the arrowhead body the annular wall of the tip contacts the forward side of each protrusion and causes corresponding cantilever sections to flex as the tip is rotated or turned to tighten it thereon, except for when the notch is rotated into alignment with a protrusion whereupon the protrusion is mated into the notch by the urging force of the corresponding flexed cantilever sections and a click sound is emitted. As the tip is continued to be screwed onto the arrowhead body the mating of the notch and a protrusion occurs every ⅓ turn until the tip is completely tighten thereto and the notch is left mated with a protrusion. Since the notch is in-line or coplanar with one of the three facet juncture cutting edges of the trocar tip, and since each protrusion is also substantially in-line or coplanar with its corresponding arrowhead blade, when the tip is tightened onto the arrowhead body and stopped at the last click or mating of the notch and one of the protrusions each cutting edge of the trocar tip is in-line or coplanar with a cutting edge of an arrowhead blade. Also, the trocar tip is locked in place such that it can not rattle or vibrate loose. Such an arrowhead tip creates an arrowhead that always has the cutting edges of the tip in-line with the cutting edges of the arrowhead blades every time the tip or a tip is attached to the arrowhead. Such an arrowhead tip therefore creates a more lethal and better arrowhead.

Another embodiment of the present invention differs from the above disclosed embodiment in that the arrowhead body is a blade-opening arrowhead body having blade slots that extend forward into communication with an annular shelf also situated about a male stud, and that the alignment washer and arrowhead tip have slightly different structural characteristics. The alignment washer has three smaller width forward extending protrusions and three larger width rearwardly extending protrusions. The arrowhead tip has one notch formed in an internal annular wall. The notch is not coplanar with any of the tip facet juncture cutting edges. The notch is of a width so as to be matable with one forward extending protrusions of the alignment washer. Each rearward extending protrusion of the alignment washer seats within a blade slot and prevents undesirably movement or rotation of the alignment washer about the stud and arrowhead body. Since the forward extending protrusions of the alignment washer are not coplanar with any of the arrowhead body blade slots the notch is not coplanar with any of the tip facet juncture cutting edges either. The notch however, is formed in the arrowhead tip in such a location that when the tip cutting edges are coplanar with corresponding arrowhead blade cutting edges the notch is mated with a forward extending protrusion, thus allowing the cutting edges of both the tip and arrowhead blades to be in-line or coplanar with each other every time the tip or a similar tip is secured to the arrowhead body, as is according to the desired results of this invention.

Other embodiments of this invention differ from the above described embodiments in that the arrowhead tips have tip blades that are removably attachable therewith. The razor sharp cutting edges of the tip blades are aligned coplanar with the facet juncture cutting edges of the arrowhead tips and therefore are also coplanar with the cutting edges of the arrowhead blades when corresponding arrowhead tips are secured to corresponding arrowhead bodies.

Yet other embodiments of this invention differ from the above described preferred embodiments in that they have slight variations in the structural shapes, and locations of notches, protrusions, fulcrums, and tip blades as according to this invention.

As has been shown in the above discussion the arrowhead tips and arrowheads as according to this invention overcome deficiencies inherent in prior art arrowhead tips and arrowheads.

BRIEF DESCRIPTION OF THE DRAWINGS

FIG. 1 is an exploded side view of and arrowhead as according to this invention;

FIG. 2 is a side view of the arrowhead tip of the arrowhead as illustrated in FIG. 1;

FIG. 3 is a bottom view of the arrowhead tip as illustrated in FIG. 2;

FIG. 4 is an enlarged side view of the alignment washer of the arrowhead as illustrated in FIG. 1;

FIG. 5 is a top view of the alignment washer of the arrowhead as illustrated in FIG. 1;

FIG. 6 is another side view of the alignment washer of the arrowhead as illustrated in FIG. 1;

FIG. 14 is an exploded side view of a blade-opening arrowhead as according to this invention;

FIG. 15 is a side view of the alignment washer of the arrowhead as illustrated in FIG. 14;

FIG. 16 is a top view of the alignment washer of the arrowhead as illustrated in FIG. 15;

FIG. 17 is an enlarged side view of the alignment washer of the arrowhead as illustrated in FIG. 14;

FIG. 18 is a partial exploded side view of the arrowhead as illustrated in FIG. 14, showing the alignment washer seated on the arrowhead body and mated with the blade slots thereof;

FIG. 19 is a side view of the blade-opening arrowhead as illustrated in FIGS. 14 & 18, showing the arrowhead blades in the retracted or in-flight position;

FIG. 20 is a side view of the blade-opening arrowhead as illustrated in FIG. 19, showing the arrowhead blades in the open or full-cutting diameter position;

FIG. 41 is an exploded side view of another fixed-blade arrowhead as according to this invention,;

FIG. 42 is a top view of the arrowhead body as illustrated in FIG. 41;

FIG. 43 is a side view of the alignment washer as illustrated in FIG. 41;

FIG. 44 is a top view of the alignment washer as illustrated in FIG. 43;

FIG. 45 is a top view of the arrowhead body as illustrated in FIG. 42 with the alignment washer seated thereon;

FIG. 46 is a top view of the arrowhead body as illustrated in FIG. 45 with the three arrowhead blades are attached thereto;

FIG. 47 is a cross-sectional view of the arrowhead tip as illustrated in FIG. 41 as taken along line 47—47;

FIG. 48 is a top view of another arrowhead body as according to this invention; and FIG. 49 is a cross-sectional view of another arrowhead tip as according to this invention.

DETAILED DESCRIPTION OF THE PREFERRED EMBODIMENTS

Figure 7:
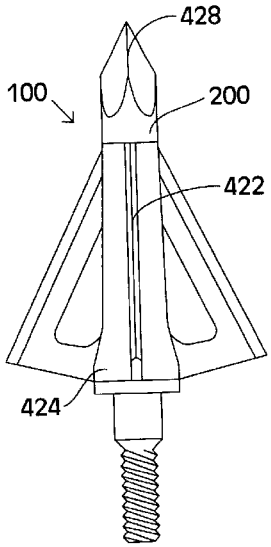
FIG. 7 is a partial exploded side view of the arrowhead as illustrated in FIG. 1, showing the alignment washer seated on the arrowhead body and mated with the arrowhead cutting blades.

Positioning means as according to this invention has the intended meaning of aligning a selected section of an arrowhead tip in a selected orientation with a selected section of an accompanying arrowhead body by the use of at least one separate element or member in addition to the arrowhead tip and the arrowhead body. The selected section of the arrowhead tip is preferably a cutting edge located at a juncture of two facets and the selected section of the corresponding arrowhead body is preferably a section of the arrowhead body that is coplanar with a blade slot thereof, so that each cutting edge of the arrowhead tip is aligned coplanar or in-line with a cutting edge of a corresponding arrowhead blade.

Positioning means as according to this invention comprises bias means for urging holding means into matable engagement with receiving means, and selection means for aligning the holding means with the receiving means so that the bias means is enabled to urge the holding means into engagement with the receiving means and therefore allowing for the alignment of the arrowhead tip with the arrowhead body in a specific orientation as is according to the desired results of this invention.

Lock means as according to this invention has the intended meaning that the arrowhead tip is prevented from un-screwing from the arrowhead body once the arrowhead is in a desired specific orientation as according to the positioning means of this invention.

FIGS. 1–13 illustrate a preferred embodiment as according to this invention. As is illustrated in FIG. 1 a fixed-blade arrowhead 100 has an arrowhead body 424, a plurality of three arrowhead blades 150—150—150 a three faceted hollow ground trocar tip 200 and an alignment washer 300. Arrowhead body 424 has a plurality of three blade slots 420—420—420, an annular shelf 416 and a threaded male stud 414. Trocar tip 200 as illustrated in FIGS. 2–3 has a hollow female cavity 412, a plurality of three cutting edges 428—428—428 located at facet junctures, an annular blade lip 410, an annular wall 406 and a notch 408. Alignment washer 300 as illustrated in FIGS. 4–6 has a plurality of three protrusions 400—400—400 each defining a void 401, a plurality of three deflectable cantilever sections 404—404—404 with one cantilever section 404 located between two protrusion 400—400, and a plurality of fulcrums 402—402—402. Each fulcrum 402 is situated in the middle of each cantilever section 404. Alignment washer 300 is preferably a stamped and/or swaged, flat, metal, deflectable, piece, but may be fabricated from a moldable organic polymer such as a plastic, fiber reinforce composite or of a rubber material. Each arrowhead blade 150 has a cutting edge 422 and a forward end 426. The forward end of cutting edge 422 of each arrowhead blade 150 abuts against annular blade lip 410 of arrowhead tip 200 when arrowhead tip 200 and blades 150—150—150 are attached to arrowhead body 424 to form fixed-blade arrowhead 100.

Although the forward end 426 of each arrowhead blade 150 is substantially flat as according to the preferred embodiment of this invention as illustrated in FIGS. 1–13 it is apparent that the leading forward end of the arrowhead blades of the fixed-blade arrowheads as according to this invention may have shapes other than being substantially flat.

Figure 8:
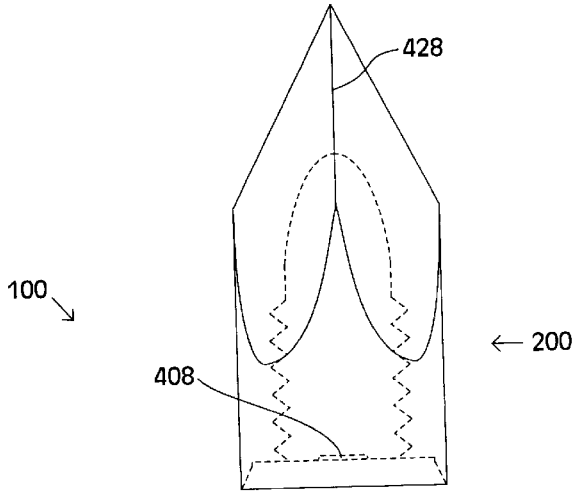
FIG. 8 is a top view of the arrowhead body as illustrated in FIG. 7 showing three blades attached to the arrowhead body in the blade slots and the alignment washer seated thereon.
Figure 8:
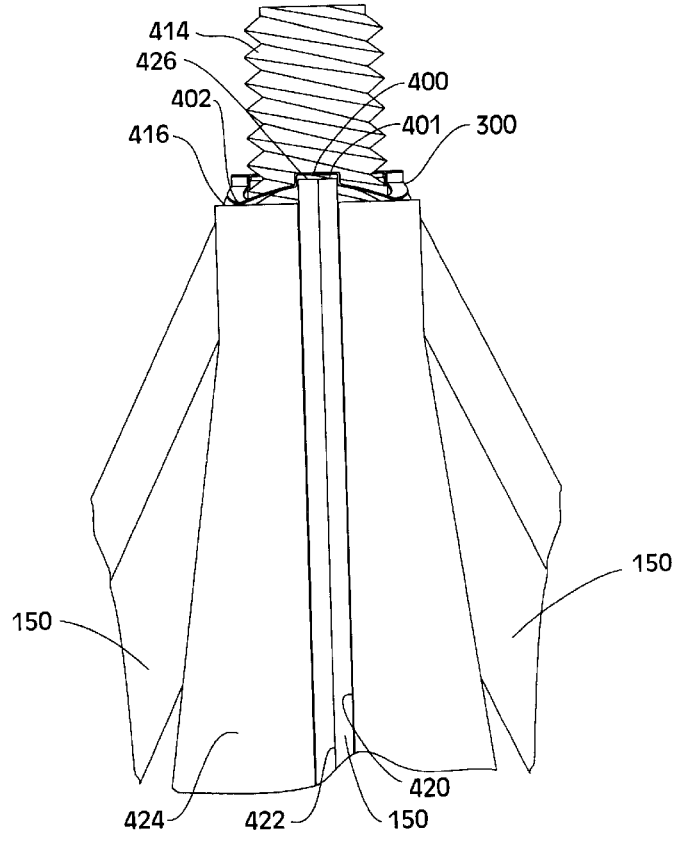
Figure 9:
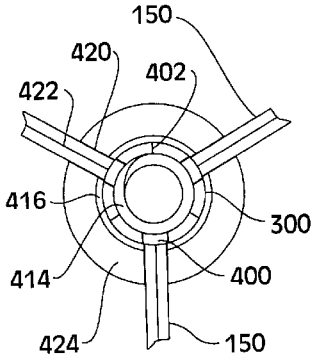
FIG. 9 is a side view of the assembled arrowhead parts of the fixed-blade arrowhead as illustrated in FIGS. 1–6.

As illustrated in FIGS. 7 & 8 when arrowhead blades 150—150—150 are inserted into corresponding blade slots 420—420—420 and alignment washer 300 is situated upon arrowhead body 424 each protrusion 400 mates with a forward end 426 of a corresponding arrowhead blade 150 and therefore prevents alignment washer 300 from rotating circumferentially about arrowhead body 424, due to the lower inside sections of each protrusion 400 abutting laterally against the sides of their corresponding arrowhead blade 150. Particularly each forward end 426 of each arrowhead blade 150 is extended into a corresponding void 401 of its corresponding mated protrusion 400. Also as illustrated in FIGS. 7 & 8 each fulcrum 402 abuts against annular shelf 416 of arrowhead body 424.

As illustrated in FIG. 7 when arrowhead tip 200 is tightened to arrowhead body 424 each cutting edge 428 is aligned or oriented coplanar with a corresponding cutting edge 422 of a corresponding arrowhead cutting blade 150.

Figure 10:
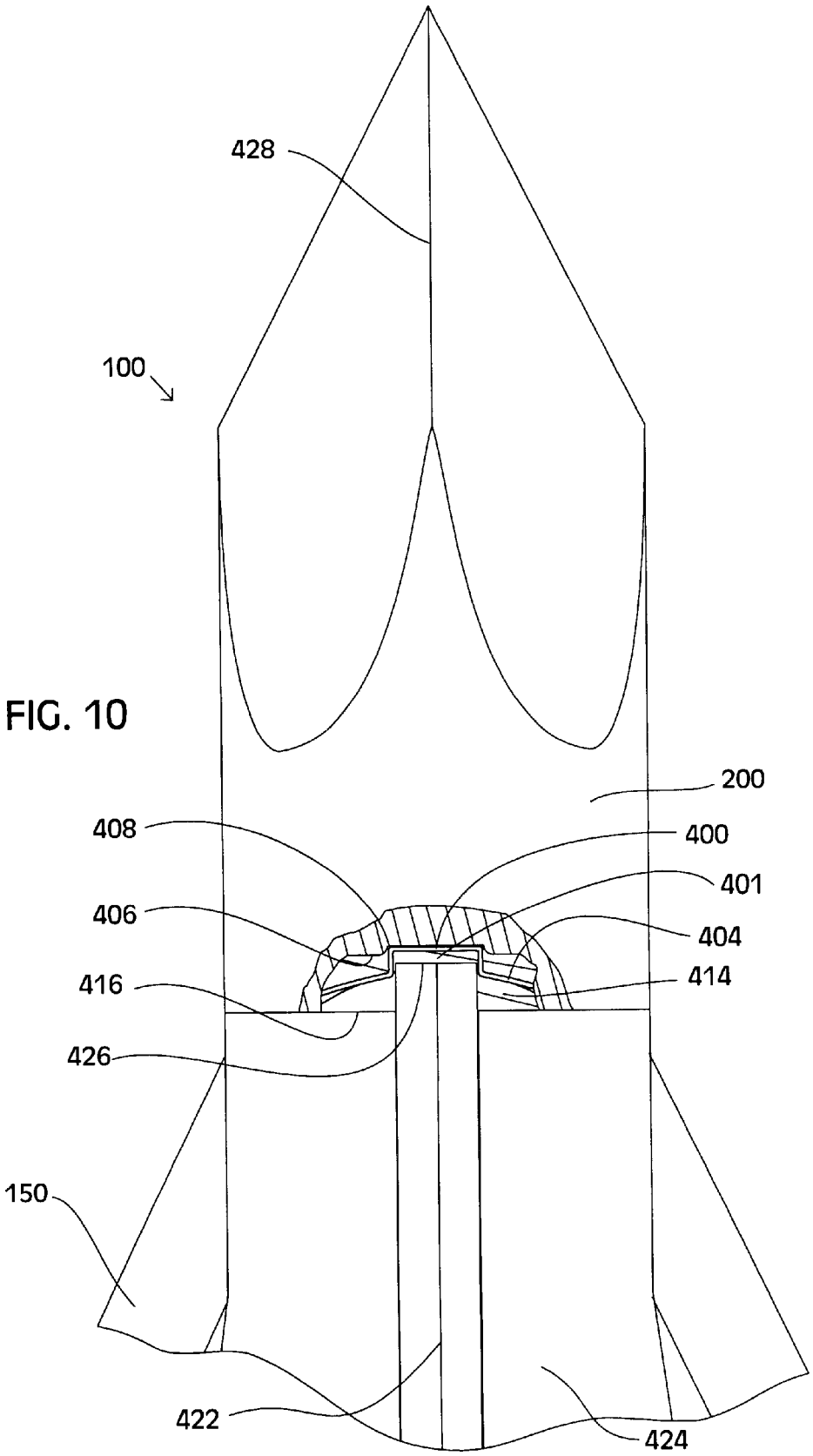
FIG. 10 is an enlarged partially cut-away view of the arrowhead as illustrated in FIG. 9 showing a protrusion of the alignment washer mated in the notch of the arrowhead tip when the arrowhead tip is completely secured to the arrowhead body.
Figure 11:
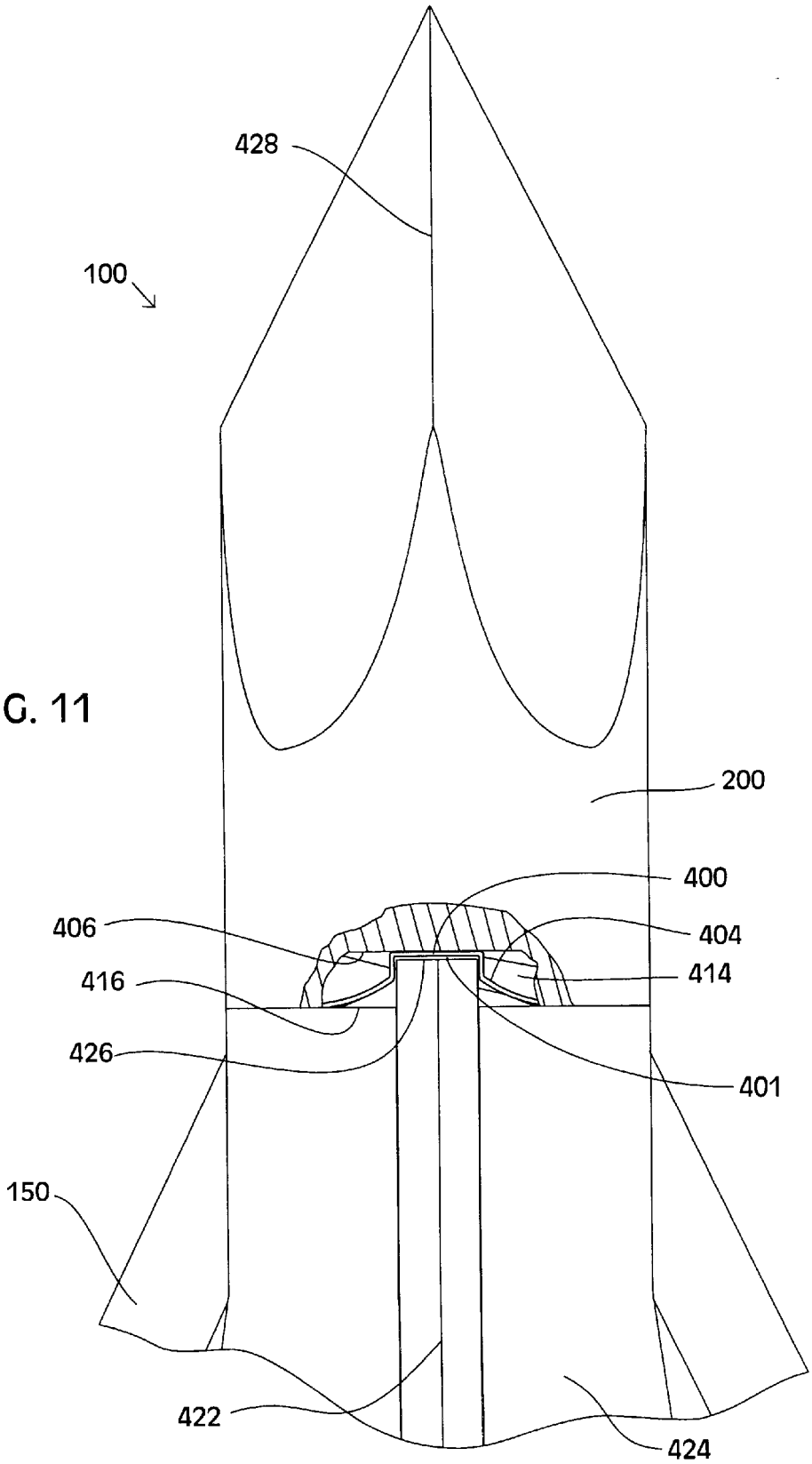
FIG. 11 is an enlarged partially cut-away view of the arrowhead as illustrated in FIG. 9 showing a protrusion of the alignment washer abutted against the annular recess of the arrowhead tip when the arrowhead tip is completely secured to the arrowhead body.
Figure 12:
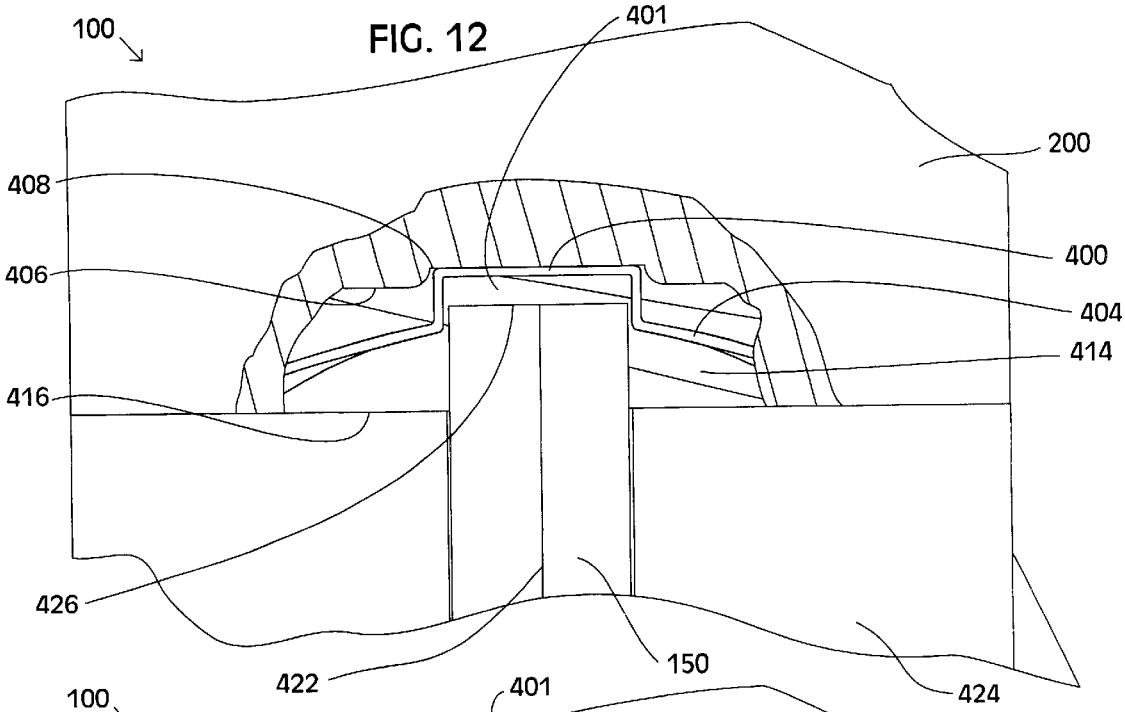
FIG. 12 is an enlarged view of the arrowhead as illustrated in FIG. 10.
Figure 13:
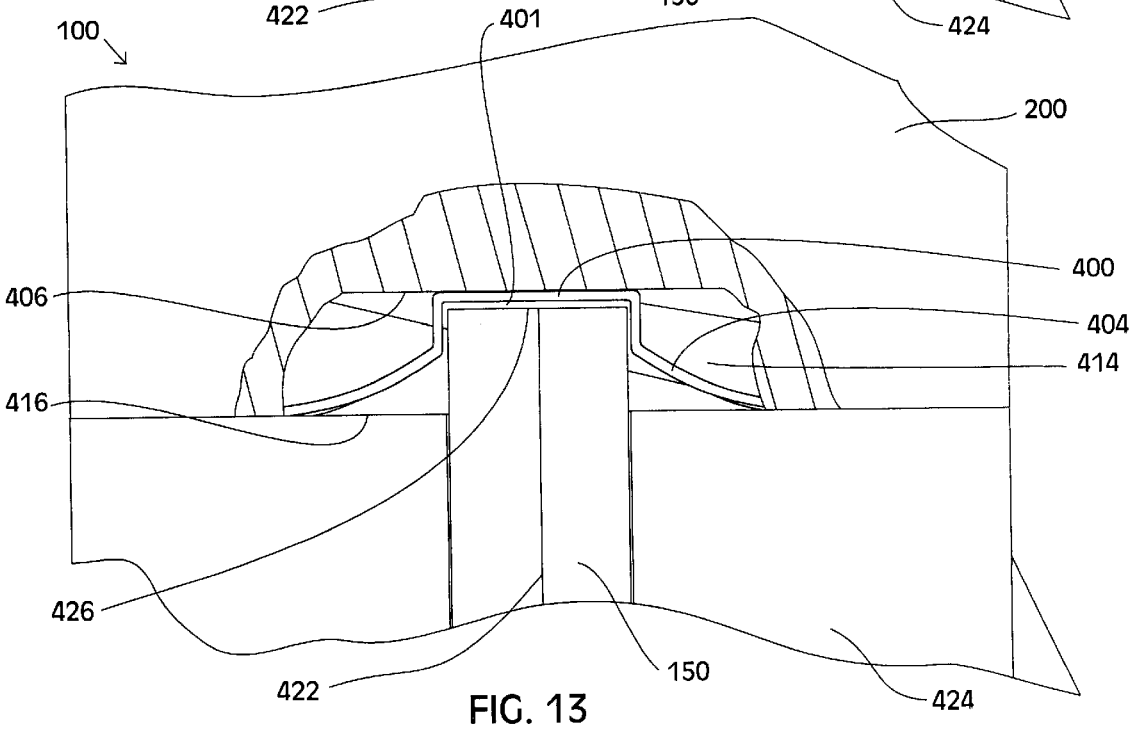
FIG. 13 is an enlarged view of the arrowhead as illustrated in FIG. 11.

FIGS. 10–13 show the positioning of all three protrusions 400—400—400 when arrowhead tip 200 is tightly attached to arrowhead body 424. FIGS. 10 & 12 show that one of the protrusions 400 is matably engaged in notch 408 of arrowhead tip 200. Whereas FIGS. 11 & 13 show how the other two protrusions 400—400 are abutted against annular wall 406 and that corresponding cantilever sections 404—404 are flexed or deflected. Even though FIGS. 11 & 13 only illustrate one protrusion 400 it is apparent that two of the three protrusions 400—400—400 are positioned such as is the protrusion 400 illustrated in FIGS. 11 & 13 when arrowhead tip 200 is tightly fastened to arrowhead body 424. Void 401 of the protrusion 400 mated within notch 408 as illustrated in FIGS. 10 & 12 is comparably larger than the voids 401—401 of the other two protrusions 400—400 as illustrated in FIGS. 11 & 13, thus showing the axial distance a protrusion 400 is displaced when engaging in notch 408 at the last click of final tightening of arrowhead tip 200 to arrowhead body 424. When arrowhead tip 200 is attached or screwed onto arrowhead body 424 each protrusion 400 when coming into abutment with annular wall 406 is displaced axially in a rearward direction such that corresponding fulcrums 402—402 are biased against annular shelf 416 of arrowhead body 424 and therefore cantilever sections 404—404 on either side of corresponding protrusions 400 are flexed thus creating an urging force as is according to the bias means of this invention. Therefore, when arrowhead tip 200 is rotated onto arrowhead body 424 and a respective protrusion 400 becomes aligned with notch 408 the urging force generated from the corresponding deflected cantilevers 404—404 urges the particular protrusion 400 into matable engagement within notch 408 and thus creates a click noise. As arrowhead tip 200 is then further screwed onto arrowhead body 424 and the protrusion 400 comes out of engagement with notch 408 the particular protrusion 400 is compressed or displaced axially in a rearward direction thus flexing corresponding cantilevers 404—404 again as is illustrated in FIGS. 11 & 13. This process is repeated for each protrusion 400 until tip 200 is snugly attached to arrowhead body 424 whereupon one of the protrusions 400 is left mated within notch 408, thus aligning the cutting edges 428—428—428 of arrowhead tip 200 with the cutting edges 422—422—422 of arrowhead blades 150—150—150 as is according to the desired results of the positioning means of this invention.

Even though the various elements of the positioning means, bias means, holding means, receiving means, selection means, and lock means of the preferred embodiments of this invention are illustrated in this specification as having certain dimensions or comparative size ratios it is apparent that the structures and dimensions of the various elements of this invention as used in practice are intended to be whatever is necessary so as to enable the arrowheads and arrowhead tips as according to this invention to achieve the desired results of this invention.

It is apparent that there exists various different possible combinations of shapes, dimensions and material compositions of the elements of this invention that comprise the positioning means, bias means, holding means, receiving means, selection means, and lock means other than heretofore disclosed in this specification that will produce the desired results as envisioned by this invention.

Each protrusion 400 as according to the preferred embodiment of this invention as illustrated in FIGS. 1–13 is an example of holding means. Notch 408 is an example of receiving means. The mating of each void 401 of a protrusion 400 with forward end 426 of each arrowhead blade 150 is an example of selection means. And the mating of a protrusion 400 with notch 408 in combination with the selection means as disclosed above in the preferred embodiment of this invention as illustrated in FIGS. 1–13 is an example of lock means as according to this invention.

It is apparent that even if arrowhead tip 200 does not come into complete exact abutment with annular shelf 416 of arrowhead body 424 that the lock means as according to this invention will prevent arrowhead tip 200 from any undesired rotational or circumferential displacement such as unscrewing from arrowhead body 424 or rattling or vibrating loose therefrom and thus maintain the cutting edges of the tip and the arrowhead blades in coplanar alignment until the archer dis-assembles them from one another. It is apparent that if arrowhead tip 200 were damaged, from when an arrow having arrowhead 100 attached thereto impacts a rock or other hard objects when being shot, that another tip 200 could be simply screwed onto arrowhead body 424 and that the cutting edges of the new tip 200 and the cutting edges of the arrowhead blades 150—150—150 would also be aligned or oriented in the, coplanar relation as disclosed above.

It is apparent that the thread pitch or number of threads per linear inch of stud 414 and cavity 412 or their equivalents as according to other embodiments of this invention can be fine enough so as to assure that the rearward end of arrowhead tip 200 abuts against annular shelf 416 of arrowhead body 424 when a protrusion 400 matably engages in notch 408 at the final tightening of arrowhead tip 200 to arrowhead body 424.

FIGS. 14–20 illustrate another preferred embodiment as according to this invention. A blade-opening arrowhead 102 has an arrowhead body 436, a plurality of three pivotal arrowhead blades 152—152—152 each with a cutting edge 448 as illustrated in FIGS. 19 & 20, a three faceted hollow ground trocar tip 202 and an alignment washer 302. Arrowhead body 436 has a plurality of three blade slots 437—437—437 which each communicate with an annular shelf 435 located near the forward end of arrowhead body 436, and a threaded male stud 434. Trocar tip 202 has a hollow female cavity 438, a plurality of three cutting edges 446—446—446 located at facet junctures, an annular wall 440, a notch 442, and a cavity 444 that allows tip 202 to be threaded to arrowhead body 436 without the collision of tip 202 with alignment washer 302. Notch 442 is equidistantly displaced between two cutting edges 446—446 of arrowhead tip 202, and is therefore not coplanar with a cutting edge 446. Alignment washer 302 as illustrated in FIGS. 14–18 has a plurality of three forward extending protrusions 432—432—432, and a plurality of three reward extending protrusions 430—430—430. Each protrusion 430 mates in a corresponding blade slot 437 of arrowhead body 436 when alignment washer 302 is situated upon arrowhead body 436 as is illustrated in FIG. 18. Each protrusion 432 is equidistantly displaced between two blade slots 437—437 of arrowhead body 436 when alignment washer 302 is situated on arrowhead body 436.

When arrowhead tip 202 is screwed onto arrowhead body 436 each protrusion 432 when coming into abutment with annular wall 440 is displaced axially in a rearward direction such that corresponding cantilever sections 431—431 on either side thereof are flexed thus creating an urging force as is according to the bias means of this invention. Therefore, when arrowhead tip 202 is screwed onto arrowhead body 436 and a respective protrusion 432 becomes aligned with notch 442 the urging force generated from corresponding deflected cantilevers 431—431 urges the protrusion 432 into matable engagement within notch 442. As arrowhead tip 202 is then further screwed onto arrowhead body 436 the particular protrusion 432 is displaced axially in a rearward direction thus flexing cantilevers 431—431 again as the protrusion 432 comes out of engagement with notch 442. This process is repeated for each protrusion 432 until tip 202 is snugly attached to arrowhead body 436 and one of the protrusions 432 is left mated with notch 442, thus aligning the tip cutting edges 446—446—446 with the arrowhead blade cutting edges 448—448—448 as is illustrated in FIG. 20.

Each protrusion 432 as according to the preferred embodiment of this invention as illustrated in FIGS. 14–20 is an example of holding means. Notch 442 is an example of receiving means. The mating of each protrusion 430 with the corresponding blade slots 437 is an example of selection means. And the mating of a protrusion 432 in notch 442 in combination with the selection means as disclosed above in the preferred embodiment of this invention as illustrated in FIGS. 14–20 is an example of lock means as according to this invention.

Figures 21, 22, 23, 24, 25, 26, 27, 28:
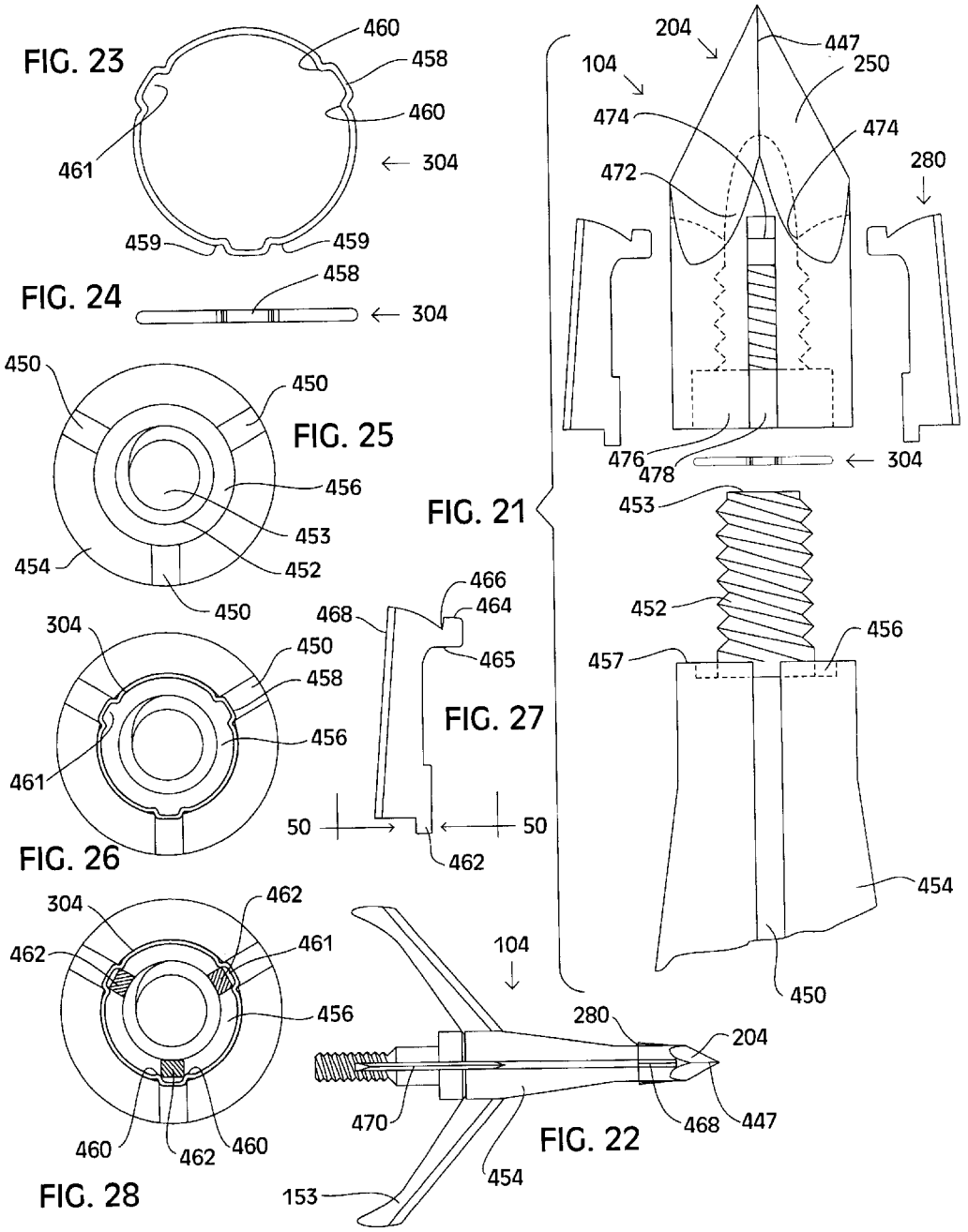
FIG. 21 is an exploded side view of another blade-opening arrowhead as according to this invention, that has removably attachable tip blades.
FIG. 22 is a side view of the assembled blade-opening arrowhead as illustrated in FIG. 21.
FIG. 23 is a top view of the alignment washer of the arrowhead as illustrated in FIGS. 21 & 22.
FIG. 24 is a side view of the alignment washer as illustrated in FIG. 23.
FIG. 25 is a top view of the arrowhead body of the arrowhead as illustrated in FIG. 21.
FIG. 26 is a top view of the arrowhead body as illustrated in FIG. 25 with the alignment washer seated thereon.
FIG. 27 is a side view of a tip blade of the blade-opening arrowhead as illustrated in FIG. 21.
FIG. 28 is a top view of the arrowhead body as illustrated in FIG. 25 with the alignment washer seated thereon and showing the position where the three tip blades are situated when the arrowhead tip is secured to the arrowhead body - the three tip blades are illustrated by showing cross-sectional segments of leg portions of each tip blade as taken along line 50—50 of FIG. 27.

FIGS. 21–28 illustrate another preferred embodiment as according to this invention. A blade-opening arrowhead 104 has an arrowhead body 454, a plurality of three pivotal arrowhead blades 153—153—153 each with a cutting edge 470 as illustrated in FIG. 22, an alignment washer 304, and a three faceted hollow ground trocar tip 204 that has a plurality of three tip blades 280—280—280 removably attachable therewith. Arrowhead body 454 has a plurality of three blade slots 450—450—450 which each communicate with an annular recess 456 situated near the forward end of arrowhead body 454 and about a threaded male stud 452. Arrowhead body 454 also has an annular shelf 457 which abuts against the rear section of arrowhead tip 204 when arrowhead tip 204 is attached to arrowhead body 454, and a flat 453 located at the forward end of stud 452. Trocar tip 204 has a tip body 250, a female cavity 472, a plurality of three cutting edges 447—447—447 located at facet junctures, a leg cavity 476, a plurality of three tip blade slots 478—478—478 each with a catch-lip 474 located therein. Each tip blade 280 has a cutting edge 468, a protrusion 464, a notch 466, a leg 462, and a flat 465 which abuts with flat 453 of stud 452 when arrowhead tip 204 is attached to arrowhead body 454. Alignment washer 304 as illustrated in FIG. 23 has a plurality of three radially outwardly extending protrusions 458—458—458 each with a pair of knobs 460—460, and a plurality of three pairs of cantilever or deflectable sections 459—459, 459—459, 459—459. Each protrusion 458 of alignment washer 304 defines a void 461. Each cantilever section 459 of each pair of cantilever sections 459—459 is situated on opposite sides of a corresponding protrusion 458 as is illustrated in FIGS. 23, 26 & 28. Each protrusion 458 when alignment washer 304 is seated in annular recess 456 mates in a corresponding blade slot 450 of arrowhead body 454 as is illustrated in the top view of arrowhead body 454 as shown in FIG. 26.

It is apparent that alignment washer 304 and other elements and their equivalents comprising bias means as according to this invention could be fabricated or swaged from round metal wire stock or could be manufactured from injection molding of a plastic or composite material or fabricated from other materials and by other manufacturing processes.

It is apparent that an alignment washer as according to this invention which is similar in shape to alignment washer 304 could have flexible cantilever sections that are found in different locations upon the alignment washer than the locations cantilever sections 459—459, 459—459, 459—459 are at on alignment washer 304.

When arrowhead tip blades 280—280—280 are assembled to tip body 250 so as to form arrowhead tip 204 and then arrowhead tip 204 is attached or screwed onto arrowhead body 454 each leg 462 of each tip blade 280 clicks in and out of voids 461—461—461 as tip 204 is rotated about arrowhead body 454 until tip 204 is tightened to arrowhead body 454 and each leg 462 is matably engaged within a void 461. Each leg 462 when its corresponding tip blade 280 is being rotated towards a protrusion 458 first contacts a knob 460 which causes the corresponding cantilever or deflectable section 459 to be flexed and therefore the particular protrusion 458 is laterally displaced further outward into the corresponding blade slot 450. This allows the leg 462 to mate in the respective void 461. The top view of arrowhead body 454 as shown in FIG. 28 illustrates cross-sectional segments of all three legs 462—462—462, of tip blades 280—280—280 as taken along line 50—50 of FIG. 27, mated in corresponding voids 461—461—461 as they would be when tip 204 is completely secured, positioned and locked in orientation with arrowhead body 454 as according to the desired results of this invention. As is illustrated in FIG. 22 each cutting edge 447 of tip 204 is coplanar with both a cutting edge 468 and a cutting edge 470.

Each leg 462 of each tip blade 280 as according to the preferred embodiment of this invention as illustrated in FIGS. 21–28 is an example of holding means. Each void 461 created by the shape of corresponding knobs 460 and protrusions 458 is an example of receiving means. The mating of protrusion 458 within corresponding blade slots 450 is an example of selection means. And the abutment of a knob 460 against one lateral side of a tip blade leg 462 and the abutment of a second knob 460 against the opposing lateral side of the same tip blade leg 462, when a tip blade 280 is mated in a void 461 in combination with the selection means as disclosed above in the preferred embodiment of this invention as illustrated in FIGS. 21–28 is an example of lock means as according to this invention.

Although each tip blade 280 of arrowhead 104 is substantially as thick as the thickness of an arrowhead cutting blade 153 it is apparent that the tip blades and arrowhead blades, of the arrowheads according to this invention having tip blades, may be of different thicknesses than each other.

It is apparent that in the arrowheads as according to this invention having tip blades that utilize notches and protrusions for means of securing the tip blades to their respective arrowhead tip bodies such as notches 466—466—466 and protrusions 464—464—464 of tip blades 280—280—280 of arrowhead 104 as illustrated above, that the tip blade protrusions will be displaced a distance forward of corresponding catch-lips of the corresponding tip bodies when corresponding notches are mated with corresponding catch-lips as occurs when the tip bodies and tip blades are tightened to their respective arrowhead bodies, thus securely attaching the tip blades to their corresponding tip bodies.

The bias means as according to this invention may comprise any element or elements that produce an urging force, such as that which is attainable from elements or members that are resilient, deflectable, flexible or that have the ability to return to their original shape or toward their original shape after being compressed or deformed therefrom. The flat metal alignment washers as according to this invention act as leaf springs or cantilever elements that produce an urging force as according to the bias means of this invention. It is apparent that the bias means of this invention may comprise an annular spring or coil spring. It is also apparent that a ball bearing or equivalent could be used as holding means as according to this invention and that such ball bearing when used in combination with an coil spring having a similar outer diameter as the ball bearing so as to cause the ball bearing to be urged or biased into matable engagement with receiving means as according to this invention could produce an arrowhead that exemplifies the desired results as envisioned by this invention.

Figure 31:
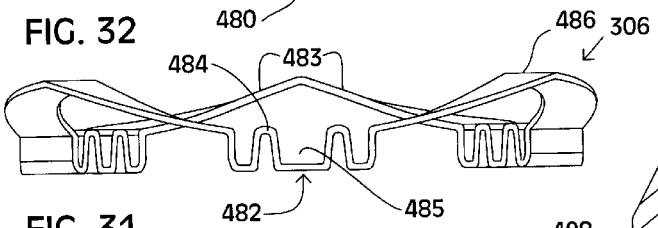
FIG. 31 is a side view of the alignment washer of the arrowhead as illustrated in FIGS. 29 & 30.
Figure 29:
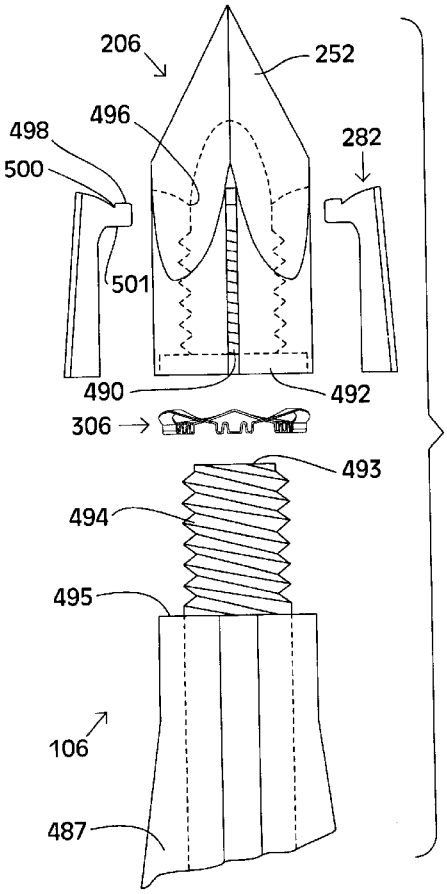
FIG. 29 is an exploded side view of another blade-opening arrowhead as according to this invention, that has removably attachable tip blades.
Figure 30:
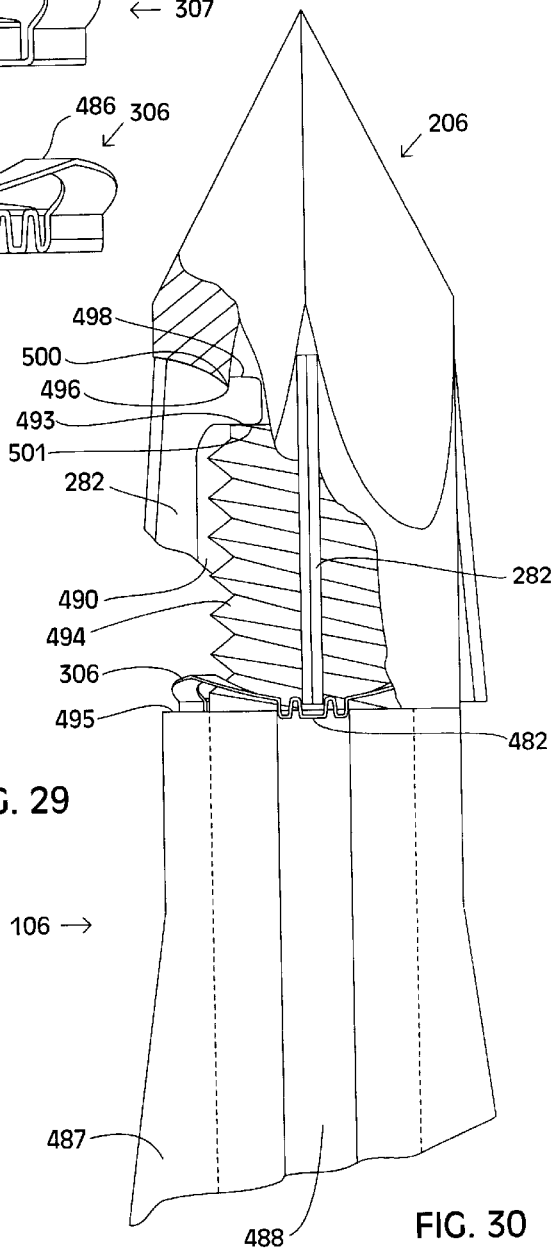
FIG. 30 is an enlarged partial cut-away view of the assembled blade-opening arrowhead as illustrated FIG. 29.

FIGS. 29–32 illustrate another preferred embodiment as according to this invention. A blade-opening arrowhead 106 has an arrowhead body 487, a plurality of pivotal arrowhead blades, an alignment washer 306, and a three faceted hollow ground trocar tip 206 that has a plurality of three tip blades 282—282—282 removably attachable therewith. Arrowhead body 487 has a plurality of three blade slots 488—488—488 which each communicate with an annular shelf 495 situated near the forward end of arrowhead body 487 and about a threaded male stud 494. Stud 494 has a flat 493 located at its forward end. Trocar tip 206 has a tip body 252, a female cavity, a plurality of three cutting edges located at facet junctures, a cavity 492, a plurality of three tip blade slots 490—490—490 each with a catch-lip 496 located therein. Each tip blade 282 has a cutting edge, a protrusion 498, a notch 500, and a flat 501 which abuts with flat 493 of stud 494 when arrowhead tip 206 is attached to arrowhead body 487. Alignment washer 306 as illustrated in FIG. 31 has a plurality of three reward extending protrusions 482—482—482 each with a pair of bends 484—484, and a plurality of three cantilever or deflectable sections 483—483—483 with one cantilever section 483 located between two protrusion 482—482, and a plurality of three fulcrums 486—486—486. One fulcrum 486 is situated in the middle of each cantilever section 483.

When arrowhead tip blades 282—282—282 are assembled to tip body 252 so as to form arrowhead tip 206 and then arrowhead tip 206 is attached or screwed onto arrowhead body 487 each tip blade 282 seats in a void 485 of protrusion 482 thus making the three tip blades 282—282—282 an integral rotating unit with alignment washer 306. Arrowhead 106 is preferably held in a vertical position with arrowhead tip 206 pointing down when tip 206 is screwed onto arrowhead body 487 so as to utilize the force of gravity to keep each tip blade 282 mated in its corresponding void 485. Therefore when tip 206 is screwed onto arrowhead body 487 each protrusion 482 clicks in and out of blade slots 488—488—488 until tip 206 is tightened to arrowhead body 487 and each protrusion 482 is matably engaged within a blade slot 488 and tip 206 is completely secured, positioned and locked in orientation with arrowhead body 487 as is according to the desired results of this invention. Such a locked orientation aligns the cutting edges of the facet junctures with both the cutting edges of the tip blades and the cutting edges of the pivotal arrowhead blades, and thus produces a blade-opening arrowhead that has far superior penetrating qualities than prior art blade-opening arrowheads.

Each protrusion 482 as according to the preferred embodiment of this invention as illustrated in FIGS. 29–32 is an example of holding means. Each blade slot 488 is an example of receiving means. The mating of each tip blade 282 within the corresponding voids 485 created by corresponding bends 484—484 is an example of selection means. The mating of each protrusion 482 with a blade slot 488 in combination with the selection means as disclosed above in the preferred embodiment of this invention as illustrated in FIGS. 29–32 is an example of lock means as according to this invention.

Figure 32:
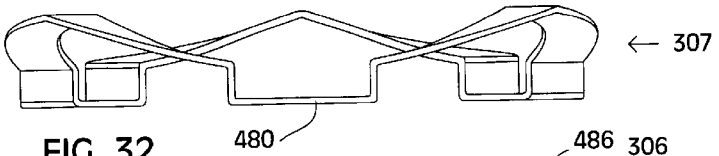
FIG. 32 is an enlarged side view of another alignment washer as according to this invention.

It is apparent that by use of an alignment washer such as alignment washer 307 as illustrated in FIG. 32 that tip blades having a thickness substantially similar to the thickness of their corresponding arrowhead blades can be used to rotate with their respective tip body and alignment washer as a single unit as has been exemplified herein by arrowhead 106 in FIGS. 29–32. It is also apparent that elements other than bends 484—484 could be associated with the alignment washers or equivalents as according to this invention and provide the functions that bends 484—484 perform without deterring from the desired results of this invention.

Figures 33, 34, 35:
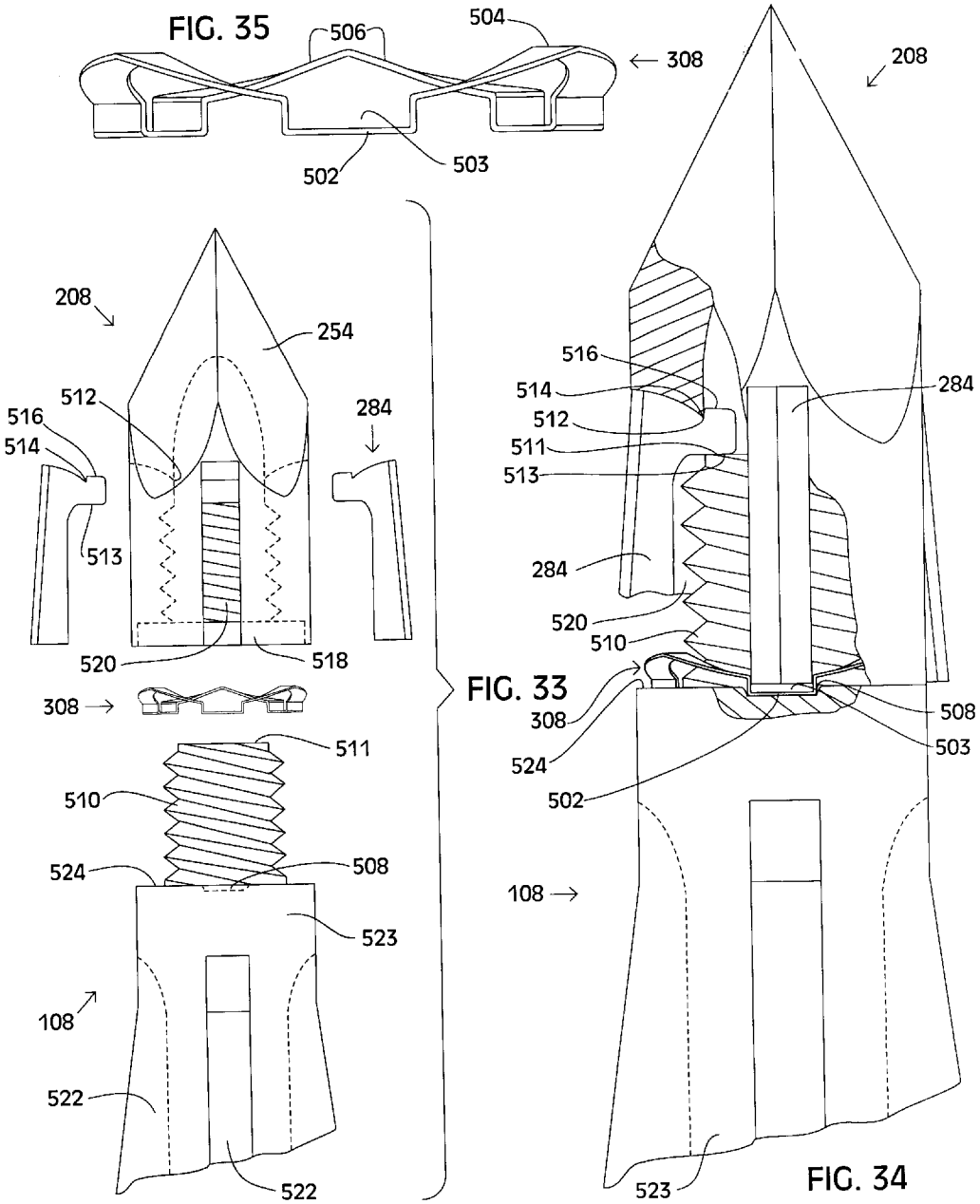
FIG. 33 is an exploded side view of another blade-opening arrowhead as according to this invention, that has removably attachable tip blades.
FIG. 34 is an enlarged partial cut-away view of the assembled blade-opening arrowhead as illustrated FIG. 33.
FIG. 35 is a side view of the alignment washer of the arrowhead as illustrated in FIGS. 33 & 34.

FIGS. 33–35 illustrate another preferred embodiment as according to this invention wherein a blade-opening arrowhead 108 which is similar to blade-opening arrowhead 106 as illustrated in FIGS. 29–32 has an arrowhead body 523, a plurality of pivotal arrowhead blades, an alignment washer 308, and a three faceted hollow ground trocar tip 208 that has a plurality of three tip blades 284—284—284 removably attachable therewith. Blade-opening arrowhead 108 however, has a plurality of three blade slots 522—522—522 that do not communicate with an annular shelf 524 of arrowhead body 523, and a notch 508 formed in annular shelf 524. Arrowhead tip 208 has a tip body 254, a female cavity, a plurality of three cutting edges located at facet junctures, a cavity 518, a plurality of three tip blade slots 520—520—520 each with a catch-lip 512 located therein. Each tip blade 284 has a cutting edge, a protrusion 516, a notch 514 and a flat 513. Alignment washer 308 as illustrated in FIG. 35 has a plurality of three protrusions 502—502—502, and a plurality of three cantilever sections 506—506—506, and a plurality of fulcrums 504—504—504. Each fulcrum 504 is situated in the middle of each cantilever section 506 and abuts against arrowhead tip 208 when arrowhead tip 208 is attached to arrowhead body 523 thus causing the flexing of cantilever sections 506 and therefore the production of an urging force. Alignment washer 308 fits within cavity 518 when arrowhead tip 208 is attached to arrowhead body 523.

When arrowhead tip blades 284—284—284 are assembled to tip body 254 so as to form arrowhead tip 208 and then arrowhead tip 208 and alignment washer 308 are screwed onto arrowhead body 523 flat 513 of each tip blade 284 seats upon a flat 511 of a stud 510 of arrowhead body 523 so as to ensure that the rear end of each tip blade 284 mates in a void 503 of a corresponding protrusion 502 so as to leave enough room to allow each protrusion 502 to be axially displaced in both a forward and rearward direction when engaging and dis-engaging with notch 508 yet at the same time allowing the three tip blades 284—284—284 to be an integral rotating unit with alignment washer 308 when tip 208 is screwed onto arrowhead body 523. Arrowhead 108 is preferably held in a vertical position with arrowhead tip 208 pointing down when tip 208 is being screwed on to arrowhead body 523 so to utilize the force of gravity to keep each tip blade 284 mated in its corresponding void 503. Therefore, when tip 208 is screwed onto arrowhead body 523 each protrusion 502 clicks in and out of notch 508 as corresponding cantilevers 506—506 are flexed and un-flexed when corresponding protrusions 502 are rotated into alignment therewith until tip 208 is tightened to arrowhead body 523 and one protrusion 502 is matably engaged within notch 508, whereupon tip 208 is completely secured, positioned and locked in orientation with arrowhead body 523 as according to the desired results of this invention. This locked orientation also aligns the cutting edges of the facet junctures with both the cutting edges of the tip blades and the cutting edges of the pivotal arrowhead blades as according to the positioning means of this invention.

Each protrusion 502 as according to the preferred embodiment of this invention as illustrated in FIGS. 33–35 is an example of holding means. Notch 508 is an example of receiving means. The mating of each tip blade 284 within the corresponding voids 503—503—503 is an example of selection means. The mating of a protrusion 502 with notch 508 in combination with the selection means as disclosed above in the preferred embodiment of this invention as illustrated in FIGS. 33–35 is an example of lock means as according to this invention.

FIGS. 36–40 illustrate yet another preferred embodiment as according to this invention wherein a fixed-blade arrowhead 110 which is similar to fixed-blade arrowhead 100 as illustrated in FIGS. 1–13, except arrowhead 110 has a plurality of three tip blades 286—286—286 each with a notch 532, a protrusion 530, a cutout 536, and a removably attachable arrowhead tip 210 that has a threaded male stud 542 which threads into a female cavity 544 of an arrowhead body 554. Fixed-blade arrowhead 110 utilizes an alignment washer 310. Arrowhead body 554 has a plurality of three blade slots 545—545—545, and an annular shelf 547. Arrowhead tip 210 has a plurality of three cutting edges 550—550—550 located at facet junctures, an annular blade lip 540 that serves to maintain each of the three arrowhead blades 158—158—158 attached to the arrowhead body, an annular wall 541 and a notch 538. Alignment washer 310 has a plurality of three protrusions 530—530—530 each defining a void 531, a plurality of three deflectable cantilever sections 533—533—533, and a plurality of fulcrums.

Figure 38:
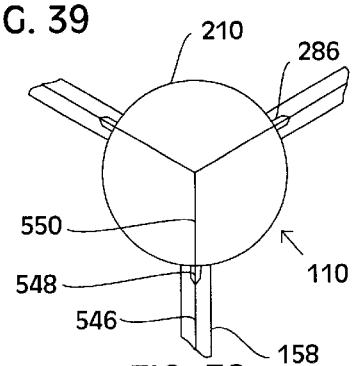
FIG. 38 is a top view of the assembled arrowhead as illustrated in FIG. 37.
Figure 37:
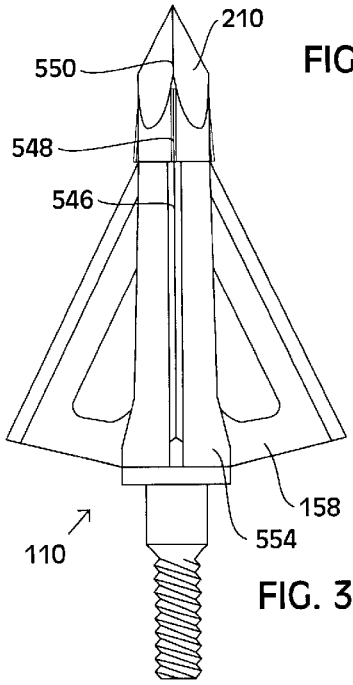
FIG. 37 is a side view of the assembled fixed-blade arrowhead as illustrated in FIG. 36.
Figure 36:
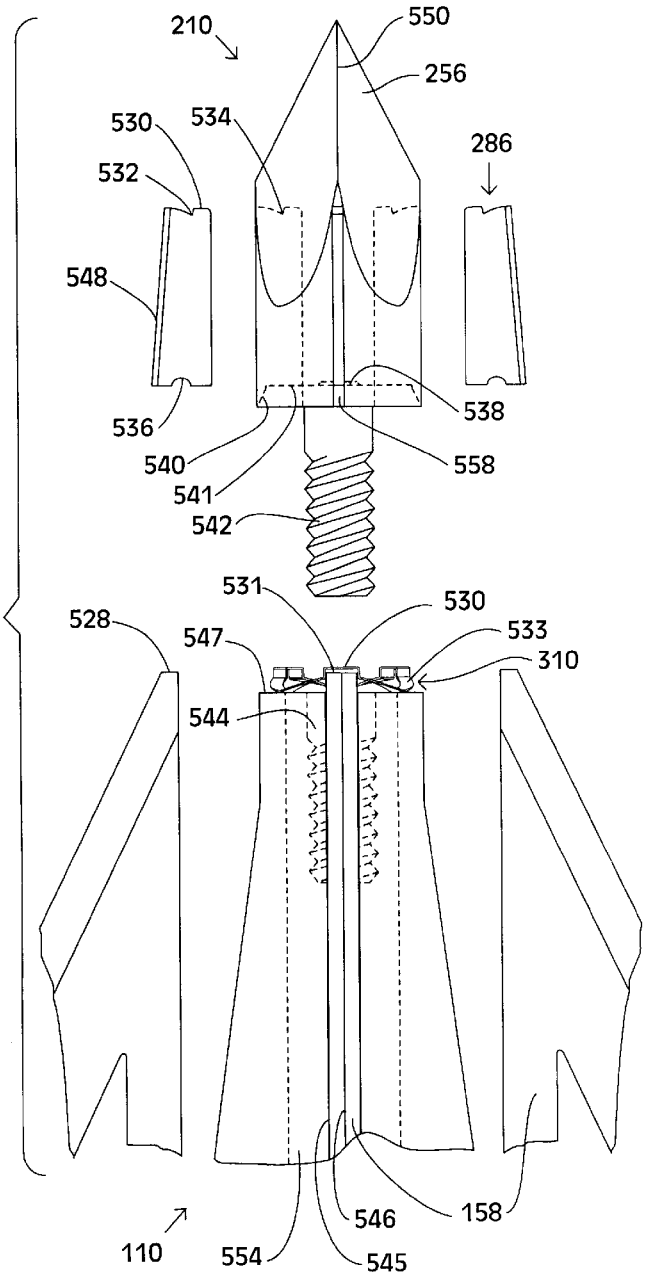
FIG. 36 is an exploded side view of a fixed-blade arrowhead as according to this invention, that has removably attachable tip blades.

When arrowhead tip blades 286—286—286 are assembled to tip body 256 and then arrowhead tip 210 is screwed into cavity 544 each cutout 536 of each tip blade 286 allows sufficient space for tip blades 286—286—286 to clear or avoid colliding with alignment washer 310 so that tip 210 is enabled to be tightly attached and locked to arrowhead body 554 as is illustrated in FIG. 37. This locked orientation aligns the cutting edges of the facet junctures with both the cutting edges of the tip blades and the cutting edges of the fixed-blade arrowhead blades as illustrated in FIG. 38 as according to the positioning means and desired results of this invention.

Figure 39:
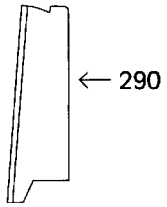
FIG. 39 is a side view of another tip blade as according to this invention.
Figure 40:
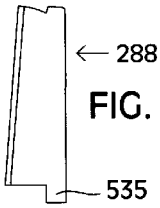
FIG. 40 is a side view of another tip blade as according to this invention.

As is apparent from a tip blade 288 having a leg 535 as illustrated in FIG. 40, and a tip blade 290 as illustrated in FIG. 39 the tip blades as according to this invention may have legs or other elements, structures or shapes associated therewith that aid in the securement of the tip blades to their corresponding tip bodies other than has been suggested herein.

It is apparent that a stabilizing member can be used to hold or stabilize the tip blades as according to this invention in proper position with their corresponding tip bodies when attaching or screwing the tips as according to this invention that have tip blades removably attachable therewith to corresponding arrowhead bodies. The stabilizing member may be a plastic cap type device that is shaped so as to fit over the tip body and attached tip blades in a snug manner so as to allow the user to grip the cap and attach the tip and tip blades to the arrowhead body by twisting or rotating the plastic cap. It is also apparent that the stabilizing member may be associated with a broadhead wrench, and that the stabilizing member may have grip extensions to allow the user to easily generate sufficient frictional engagement with the stabilizing member to securely tighten the tip to the arrowhead body.

FIGS. 41–47 illustrate another preferred embodiment as according to this invention. A fixed-blade arrowhead 112 has an arrowhead body 598, a plurality of three arrowhead blades 160—160—160 each with a cutting edge, an alignment washer 312, and a three faceted arrowhead tip 212. Arrowhead body 598 has a plurality of three blade slots 590—590—590 which each communicate with an annular shelf 596 and a threaded stud 586 located at the forward end of arrowhead body 598. Arrowhead body 598 also has a belt 588 circumscribing stud 586. Belt 588 as is illustrated in FIG. 41 is narrower in diameter than stud 586. Alignment washer 312 as illustrated in FIG. 44 has a plurality of three radially outwardly extending protrusions 580—580—580, a plurality of three pairs of cantilever or deflectable sections 582—582, 582—582, 582—582, and a gap 584. Gap 584 is created by the two ends of alignment washer 312 approaching each other and serves to allow alignment washer 312 to flex sufficiently to slide and expand over stud 586 so as to seat around belt 588 as is illustrated in the top view of arrowhead body 598 in FIG. 45 and therefore be positioned such to provide bias means, holding means, selection means and lock means when all of the arrowhead components are assembled together as is according to this invention. Each protrusion 580 of alignment washer 312 defines a void 581. Each cantilever section 582 of each pair of cantilever sections 582—582 is situated on opposite sides of a corresponding protrusion 580 as is illustrated in FIG. 44. Each arrowhead blade 160 has a forward end 592, a vertical side 593, and a flat shelf 594.

When arrowhead blades 160—160—160 and alignment washer 312 are attached to arrowhead body 598 as is illustrated in the top view of FIG. 46 each protrusion 580 seats around one vertical side 593 of an arrowhead blade 160 and each protrusion 580 of alignment washer 312 is therefore seated upon a shelf 594 of an arrowhead blade 160. This makes it so that alignment washer 312 cannot rotate around arrowhead body 598 but is firmly seated in a desirable position as is according to the selection means of this invention. Arrowhead tip 212 has a female cavity 570, a plurality of three cutting edges 578—578—578 located at facet junctures, an annular blade lip 572 which abuts against the cutting edge of each arrowhead blade 160 when arrowhead 112 is assembled, an annular wall 574 and a notch 576. Notch 576 is best seen in the cross-sectional view of arrowhead tip 212 as illustrated in FIG. 47.

When alignment washer 312 and arrowhead blades 160—160—160 are attached to arrowhead body 598 and then arrowhead tip 212 is screwed thereon to form arrowhead 112 each protrusion 580 clicks in and out of notch 576 until tip 212 is completely tightened to arrowhead body 598 whereupon one protrusion 580 is left engaged within notch 576 and therefore produces an arrowhead as according to the desired results of this invention.

Each protrusion 580 is an example of holding means. Notch 576 is an example of receiving means. The mating of each vertical side 593 within the corresponding voids 581—581—581 of protrusions 580—580—580 is an example of selection means. The mating of a protrusion 580 with notch 576 in combination with the selection means as disclosed above in the preferred embodiment of this invention as illustrated in FIGS. 41–47 is an example of lock means as according to this invention.

It is apparent that the alignment washers and equivalents as according to this invention such as alignment washer 312 may have gaps or equivalents, and that they and the other elements and their equivalents as according to this invention may be comprised of more than one constituent.

FIGS. 48 & 49 illustrate yet another preferred embodiment as according to this invention wherein an arrowhead has an arrowhead body 600 that has three blade slots that communicate with each other at a central axial location as is illustrated in FIG. 48, so that a plurality of three arrowhead blades each having an angularly offset flange can be inserted therein. The flange of each arrowhead blade is not coplanar with the section of the arrowhead blade having the cutting edge formed thereon. Each arrowhead blade would therefore occupy space in two of the three blade slots 602—602—602, the flange in one blade slot 602 and the cutting edge section in an adjacent slot 602. As illustrated in cross-sectional view in FIG. 49 an arrowhead tip 214 having a plurality of three notches 604 could be attached to arrowhead body 600 of FIG. 48 and in combination with an alignment washer having only one protrusion or equivalent and an accompanying deflectable cantilever section or sections would serve to provide an arrowhead and arrowhead tip that achieves the desired results as according to this invention. It is apparent that the alignment washer as according to the preferred embodiment as illustrated in FIGS. 48 & 49 could be situated within one or more of the blade slots 602—602—602 when assembled to the arrowhead.

Although the preferred embodiments as disclosed in this specification have illustrated only three cutting edges per arrowhead tip and therefore like numbers of arrowhead blade cutting edges and tip blade cutting edges it is apparent that the number of cutting edge pairs (facet edges and arrowhead blade edges) or cutting edge triplets (facet edges and arrowhead blade edges and tip blade edges) of the arrowheads of this invention is of relatively minor significance to this invention. Arrowhead tips having as few as 1 facet cutting edge or one tip blade cutting edge are within the scope of this invention, as well as arrowhead tips having 9 or more facets, where at least one juncture between facets could be aligned coplanar with another cutting edge or where none of the facet junctures are aligned coplanar with another cutting edge. It is also apparent that the arrowheads as according to this invention could have any number of arrowhead cutting blades.

Although the preferred embodiments as disclosed in this specification have illustrated that a facet juncture cutting edge is preferably aligned coplanar with an arrowhead blade cutting edge, it is apparent that as within the scope of the positioning means and the desired results of this invention that a facet juncture cutting edge may be aligned or oriented non-coplanar-with the cutting edge of a corresponding arrowhead blade, such as to induce spinning of the arrowhead while penetrating a target or for other reasons.

It is apparent that different forms of positioning means, holding means, receiving means, selection means, and lock means as according to the desired results of this invention exist which have not been discussed above. It is apparent that the different parts and structural shapes and their equivalents as according to the arrowheads and arrowhead tips of this invention, as discussed above and as according to other preferred embodiments of this invention, can be changed, or interchanged, or eliminated, or duplicated, or made of different materials, and connected to or associated with adjacent elements in different manners, other than suggested herein, without deterring from the desired results of the arrowheads and arrowhead tips as according to this invention.

It is to be understood that the present invention is not limited to the sole embodiments described above, as will be apparent to those skilled in the art, but encompasses the essence of all embodiments, and their legal equivalents, within the scope of the following claims.

I claim:

1. An arrowhead comprising:

(a) an arrowhead body, said arrowhead body comprising;

(i) a forward leading end;
(ii) a threaded stud located at said forward leading end; and
(iii) a slot formed thereon, said slot communicating with said forward leading end at an annular shelf, said annular shelf being laterally and radially displaced from said threaded stud;

(b) a cutting blade having a cutting edge, said cutting blade being removably attachable in said slot;

(c) a removably attachable arrowhead tip, said arrowhead tip comprising;
(i) an internally threaded cavity that screws said arrowhead tip onto said arrowhead body;
(ii) a cutting edge located at the juncture of two facets of said arrowhead tip; and
(iii) a notch, said notch being located in said internal cavity, said notch being intersected by a plane that is coplanar with said cutting edge of said arrowhead tip; and (d) an annular member having at least a portion thereof that is deflectable so as to generate an urging force, said annular member comprising;
(i) a protrusion, said protrusion protruding in a forward direction and seating over the forward leading end of said cutting blade when said cutting blade is attached to said arrowhead body and when said annular member is situated upon said annular shelf, said protrusion protruding a distance forward of said forward end of said cutting blade, so as that when said arrowhead tip is tightly attached on to said arrowhead body said protrusion of said annular member deflects and mates within said notch, thereby aligning said cutting edge of said removably attachable arrowhead tip with said cutting edge of said cutting blade.

2. An arrowhead as recited in claim 1, wherein said annular member has a section thereof that is substantially flat.

3. An arrowhead as recited in claim 1, further comprising three said cutting blades being attached to said arrowhead body, said arrowhead tip comprising a three faceted hollow ground trocar tip and having three cutting edges thereon, and said annular member having three said protrusions.

4. An arrowhead comprising:

(a) an arrowhead body, said arrowhead body comprising;
(i) a forward leading end;
(ii) an internally threaded cavity located at said forward leading end; and
(iii) a slot formed thereon, said slot communicating with said forward leading end at an annular shelf, said annular shelf being laterally and radially displaced from said internally threaded cavity;

(b) a cutting blade having a cutting edge, said cutting blade being removably attachable in said slot;

(c) a removably attachable arrowhead tip, said arrowhead tip comprising;
(i) a threaded stud that screws said arrowhead tip into said arrowhead body;
(ii) a cutting edge located at the juncture of two facets of said arrowhead tip; and
(iii) a notch, said notch being located on a rearward side of said tip, said notch being intersected by a plane that is coplanar with said cutting edge of said arrowhead tip; and (d) an annular member having at least a portion thereof that is deflectable so as to generate an urging force, said annular member comprising;
(i) a protrusion, said protrusion protruding in a forward direction and seating over the forward leading end of said cutting blade when said cutting blade is attached to said arrowhead body and when said annular member is situated upon said annular shelf, said protrusion protruding a distance forward of said forward end of said cutting blade, so as that when said arrowhead tip is tightly attached to said arrowhead body said protrusion of said annular member mates within said notch, thereby aligning said cutting edge of said removably attachable arrowhead tip with said cutting edge of said cutting blade.

5. An arrowhead comprising:

(a) an arrowhead body;

(b) a removably attachable arrowhead tip; and (c) means to align a section of the tip in a selected orientation with respect to a section of the body, when the tip is attached to the body, wherein the means to align is disposed upon the arrowhead so as to extend at least in part circumferentially about a central longitudinal axis of the arrowhead.

6. An arrowhead as recited in claim 5, wherein when a plurality of substantially same shaped tips are each individually attached to the body, the same selected structural section of each tip is aligned substantially in the same selected orientation with respect to the same selected section of the body.

7. An arrowhead as recited in claim 5, wherein the tip further comprises an internal hollow cavity having at least a section thereof threaded.

8. An arrowhead comprising:

(a) an arrowhead body;

(b) a removably attachable arrowhead tip; and (c) means to align a section of the tip in a selected orientation with respect to a section of the body, when the tip is attached to the body, wherein when the tip is attached to the body in a selected orientation with respect to the body, the tip is prevented from rattling or vibrating loose from the body.

9. An arrowhead as recited in claim 8, wherein the tip is threaded onto the body.

10. An arrowhead as recited in claim 9, wherein when the tip is attached to the body a plurality of times, the same selected section of the tip is aligned substantially in the same selected orientation with respect to the same selected section of the body.

11. An arrowhead as recited in claim 8, wherein the tip further comprises a cutting blade attached therewith.

12. An arrowhead comprising:

(a) an arrowhead body having a blade slot;

(b) a removably attachable arrowhead tip having a cutting edge; and (c) means to repeatedly align the cutting edge of the tip in substantial coplanar orientation with the blade slot each time the tip is attached to the body a plurality of times, wherein when the tip is attached to the body so that the cutting edge of the tip is aligned in substantial coplanar orientation with the blade slot. the tip is prevented from rattling or vibrating loose from the body.

13. An arrowhead as recited in claim 12, wherein when the tip is individually attached to a plurality of substantially same shaped arrowhead bodies the cutting edge of the tip is aligned in substantial coplanar orientation with a blade slot of each body.

14. An arrowhead as recited in claim 13, wherein a plurality of substantially same shaped tips are each individually removable attachable to each of the same shaped arrowhead bodies.

15. An arrowhead as recited in claim 12, wherein the tip further comprises a plurality of facets.

16. An arrowhead comprising:

(a) an arrowhead body having a blade slot;

(b) a removably attachable arrowhead tip having a cutting edge; and (c) means to repeatedly align the cutting edge of the tip in substantial coplanar orientation with the blade slot each time the tip is attached to the body a plurality of times, wherein the means to repeatedly align is disposed between at least a section of a rearward end of the tip and at least a section of a forward end of the body when the tip is attached to the body.

17. An arrowhead as recited in claim 16, wherein at least a portion of the means to repeatedly align is disposed at a location upon the arrowhead rearward of a threaded portion located near a forward end of the arrowhead.

18. An arrowhead as recited in claim 16, wherein at least a portion of the means to repeatedly align is disposed at a location upon the arrowhead forward of a threaded portion located near a forward end of the arrowhead.

19. An arrowhead as recited in claim 16, wherein the tip further comprises a stud having at least a section thereof threaded.

20. An arrowhead comprising:

(a) an arrowhead body;

(b) a removably attachable arrowhead tip;

(c) a deflectable element capable of producing an urging force;

(d) a void; and (e) a holding element capable of being received in the void, wherein the arrowhead is configured such that the deflectable element urges the holding element into engagement with the void so as to enable a selected section of the arrowhead tip to be aligned in a selected orientation with a selected section of the arrowhead body, when the arrowhead tip is attached to the arrowhead body.

21. An arrowhead as recited in claim 20, further comprising means to orient the holding element in coplanar alignment with the void when the tip is attached to the body so that the holding element is enabled to be urged into engagement with the void when a selected section of the arrowhead tip is aligned in a selected orientation with a selected section of the arrowhead body.

22. An arrowhead as recited in claim 21, wherein when the tip is attached to the body a plurality of times, the same selected section of the tip is aligned substantially in the same selected orientation with respect to the same selected section of the body.

23. An arrowhead as recited in claim 20, further comprising means to releasably lock the tip attached to the body in a selected orientation so that the tip stays in the selected orientation when subject to vibrations and rattling, yet is easily removable by the user.

24. An arrowhead as recited in claim 20, wherein the deflectable element is comprised of a metal.

25. An arrowhead as recited in claim 20, wherein the void is disposed on the tip.

26. An arrowhead as recited in claim 20, wherein the void is disposed on the arrowhead body.

27. An arrowhead as recited in claim 20, wherein the void comprises a notch.

28. An arrowhead as recited in claim 20, wherein the deflectable element and the holding element are disposed on the same structural entity.

29. An arrowhead as recited in claim 20, wherein the tip further comprises a plurality of facets.

30. An arrowhead comprising:

(a) an arrowhead body having a forward end and an opposing rearward end;

(b) a removably attachable arrowhead tip having a forward end and an opposing rearward end; and (c) a substantially annular element being disposed between at least a section of the rearward end of the tip and at least a section of the forward end of the body when the tip is attached to the body so as to enable a selected section of the arrowhead tip to be aligned in a selected orientation with a selected section of the arrowhead, when the arrowhead tip is attached to the arrowhead body.

31. An arrowhead as recited in claim 30, wherein the substantially annular element is comprised of a substance comprising an organic polymer.

32. An arrowhead as recited in claim 30, wherein the tip further comprises a plurality of substantially concave shaped facets.

33. An arrowhead as recited in claim 30, wherein when a plurality of substantially same shaped tips are each individually attached to the body, the same selected structural section of each tip is aligned substantially in the same selected orientation with respect to the same selected section of the body.

34. An arrowhead as recited in claim 33, wherein when each tip is attached to the body in a selected orientation with respect to the body, each tip is prevented from rattling or vibrating loose from the body.

35. An arrowhead as recited in claim 33, wherein the selected section of the arrowhead comprises a cutting blade attached to the body, and the selected section of each arrowhead tip comprises a juncture of a pair of facets thereof.

36. An arrowhead as recited in claim 35, wherein when each tip is individually attached to a plurality of substantially same shaped arrowhead bodies the facet juncture of each tip is aligned in substantial coplanar orientation with the cutting blade of the corresponding body.

37. An arrowhead as recited in claim 36, wherein each tip has a section thereof that is threaded.

38. An arrowhead comprising:

(a) an arrowhead body having a central longitudinal axis, a forward end and an opposing rearward end;

(b) a removably attachable arrowhead tip having a forward end and an opposing rearward end; and (c) a substantially annular element having at least a first section thereof that is configured substantially different than at least a second different section thereof, the substantially annular element being disposed between at least a section of the rearward end of the tip and at least a section of the forward end of the body when the tip is attached to the body so as to enable a selected section of the arrowhead tip to be aligned in a selected orientation with a selected section of the arrowhead, when the arrowhead tip is attached to the arrowhead body.

39. An arrowhead as recited in claim 38, wherein at least a section of the substantially annular element comprises a protrusion.

40. An arrowhead as recited in claim 39, wherein the protrusion projects in at least a direction substantially parallel to the central longitudinal axis of the arrowhead.

41. An arrowhead as recited in claim 39, wherein the protrusion projects in at least a direction substantially perpendicular to the central longitudinal axis of the arrowhead.

42. An arrowhead as recited in claim 39, wherein the substantially annular element has at least a section thereof that is substantially flat.

43. An arrowhead as recited in claim 38, wherein the substantially annular element comprises a gap between a pair of opposing ends.

44. An arrowhead as recited in claim 38, further comprising a threaded section disposed near the forward end of the body.

* * * * *